US006378605B1

(12) United States Patent
Kutscher et al.

(10) Patent No.: US 6,378,605 B1
(45) Date of Patent: Apr. 30, 2002

(54) HEAT EXCHANGER WITH TRANSPIRED, HIGHLY POROUS FINS

(75) Inventors: Charles F. Kutscher, Golden; Keith Gawlik, Boulder, both of CO (US)

(73) Assignee: Midwest Research Institute, Kansas City, MO (US)

( * ) Notice: Subject to any disclaimer, the term of this patent is extended or adjusted under 35 U.S.C. 154(b) by 0 days.

(21) Appl. No.: 09/453,386

(22) Filed: Dec. 2, 1999

(51) Int. Cl.[7] ..... F28F 1/24
(52) U.S. Cl. ..... 165/181; 165/907
(58) Field of Search ..... 165/151, 171, 165/181, 907

(56) References Cited

U.S. PATENT DOCUMENTS

| | | | | |
|---|---|---|---|---|
| 1,854,278 A | | 4/1932 | Smith | |
| 1,983,549 A | | 12/1934 | Krackowizer | 257/262 |
| 2,731,245 A | | 1/1956 | McChesney | 257/262 |
| 3,033,536 A | | 5/1962 | Guszmann | 257/262.16 |
| 3,205,147 A | | 9/1965 | Foure et al. | 176/61 |
| 3,416,011 A | | 12/1968 | Lyczko | 310/4 |
| 3,450,199 A | | 6/1969 | Warrell | 165/159 |
| 3,509,867 A | | 5/1970 | Brosens et al. | |
| 3,540,530 A | | 11/1970 | Kritzer | 165/146 |
| 3,568,462 A | * | 3/1971 | Hoffman et al. | 62/42 |
| 3,804,159 A | | 4/1974 | Searight et al. | 165/109 |
| 4,049,048 A | | 9/1977 | Leadham | 165/159 |
| 4,285,385 A | * | 8/1981 | Hayashi et al. | 164/9 |
| 4,768,583 A | | 9/1988 | Tsukamoto et al. | 165/110 |
| 5,056,586 A | * | 10/1991 | Bemisderfer | 165/109.1 |
| 5,211,219 A | * | 5/1993 | Kawabata et al. | 165/122 |
| 5,706,887 A | | 1/1998 | Takeshita et al. | 165/151 |
| 5,784,897 A | | 7/1998 | Shin | 62/515 |
| 5,803,165 A | | 9/1998 | Schuez et al. | 165/184 |

FOREIGN PATENT DOCUMENTS

| | | | | |
|---|---|---|---|---|
| JP | 59-147995 A | * | 8/1984 | 165/181 |
| JP | 6-11288 A | * | 1/1994 | 165/181 |
| JP | 7-248196 A | * | 7/1995 | |

* cited by examiner

*Primary Examiner*—Allen Flanigan
(74) *Attorney, Agent, or Firm*—Paul J. White

(57) ABSTRACT

The heat exchanger includes a fin and tube assembly with increased heat transfer surface area positioned within a hollow chamber of a housing to provide effective heat transfer between a gas flowing within the hollow chamber and a fluid flowing in the fin and tube assembly. A fan is included to force a gas, such as air, to flow through the hollow chamber and through the fin and tube assembly. The fin and tube assembly comprises fluid conduits to direct the fluid through the heat exchanger, to prevent mixing with the gas, and to provide a heat transfer surface or pathway between the fluid and the gas. A heat transfer element is provided in the fin and tube assembly to provide extended heat transfer surfaces for the fluid conduits. The heat transfer element is corrugated to form fins between alternating ridges and grooves that define flow channels for directing the gas flow. The fins are fabricated from a thin, heat conductive material containing numerous orifices or pores for transpiring the gas out of the flow channel. The grooves are closed or only partially open so that all or substantially all of the gas is transpired through the fins so that heat is exchanged on the front and back surfaces of the fins and also within the interior of the orifices, thereby significantly increasing the available the heat transfer surface of the heat exchanger. The transpired fins also increase heat transfer effectiveness of the heat exchanger by increasing the heat transfer coefficient by disrupting boundary layer development on the fins and by establishing other beneficial gas flow patterns, all at desirable pressure drops.

51 Claims, 11 Drawing Sheets

HEAT EXCHANGER WITH TRANSPIRED, HIGHLY POROUS FINS

The United States Government has rights in this invention under Contract No. DE-AC36-99GO10337 between the United States Department of Energy and the National Renewable Energy Laboratory, a Division of the Midwest Research Institute.

BACKGROUND OF THE INVENTION

1. Field of the Invention

The present invention relates generally to a heat exchanger for transferring heat between a gas and a liquid and, more particularly, to a fin-type heat exchanger having porous fins on the gas side that are positioned within a gas flow chamber of the heat exchanger such that all, or substantially all, of the gas is forced to pass or transpire through the large number of pores in the fins to enhance heat transfer by increasing overall heat transfer surface area and heat transfer coefficient.

2. Description of Related Art

Heat exchangers are used extensively in industrial and consumer applications, and typically employ two moving fluids, one fluid being hotter than the other, to transfer heat to the colder fluid. Many heat exchangers currently in use, such as in air conditioners, automotive radiators, process industry air-cooled condensers, and boilers, transfer heat between a gas and a single or multi-phase liquid. Typically, such heat exchangers include a number of liquid conduits, e.g., circular, oval, or flat tubes, conduits defined by plates, and the like, that are positioned within a shell or casing which defines a gas flow passage or chamber. The heat exchanger uses a fan or blower to force a gas, e.g., air, to flow within the gas flow chamber in a perpendicular (i.e., cross-flow) or parallel (i.e., counter-flow) direction relative to the liquid conduits. The resulting heat transfer between the liquid and the gas is directly proportional to the heat transfer surface area between the liquid and the gas, the temperature difference between the liquid and the gas, and the overall heat transfer coefficient of the heat exchanger. The overall heat transfer coefficient is defined in terms of the total thermal resistance to heat transfer between the gas and the liquid, and it is dependent on a number of characteristics of the heat exchanger design, such as the thermal conductivity of the material used to fabricate the conduit and the local film coefficients along the conduit, i.e., measurements of how readily heat can be exchanged between the gas and the exterior surfaces of the conduit.

Although gas-liquid heat exchangers are widely used, the heat transfer per degree of temperature difference between the hot and cold sides of these heat exchangers is quite low due in large part to the low density and low thermal conductivities of gases. This heat transfer per degree of temperature difference can be stated mathematically as the product (UA) of the overall heat transfer coefficient (U) and the heat exchange area (A). Low UA leads to relatively high operating and capital costs for gas-liquid heat exchangers because a greater number of units and/or larger capacity units that require more power must be used to account for this low UA in obtaining a desired heat transfer. For example, geothermal power plants operate at low temperature differences between the gas and the liquid and, in these power plants, more than 25 percent of the cost of producing electricity is the expense of purchasing and operating gas-liquid heat exchangers, i.e., condensers. As a result of these high costs, continuing efforts are being made to improve the UA of gas-liquid heat exchangers while at the same time controlling the manufacturing and operating cost to increase the likelihood that new heat exchanger designs will be adopted by industry and consumers.

Finned-tube heat exchangers have been used for many years to improve the gas-side heat transfer rate by increasing the heat transfer surface area available for contacting the gas as it flows through the heat exchanger. In general, finned-tube heat exchangers are cross-flow heat exchangers that include a number of tubes, i.e., conduits, for carrying the liquid fabricated from aluminum, copper, steel, or other high thermal conductivity materials. The tubes pass through and contact a series of parallel, high thermal conductivity material sheets or plates, i.e., fins, which provide an extended heat transfer area for the tubes. The overall heat transfer area is based on the number and size of included fins, with the typical number of fins used ranging from five to fifteen fins per inch. The fins define parallel channels that direct the gas flow across and among the tubes. Heat transfer occurs as the gas flows along and contacts the surface of the fins and as the gas contacts the outer surfaces of the tubes. The highest heat transfer rate on a flat surface like a flat fin occurs at the leading edge of the surface and decreases with distance from the leading edge as a boundary layer develops and thickens causing the local heat transfer coefficient to decrease. However, although finned-tube heat exchangers are widely used because they are relatively inexpensive to produce and do not create a large pressure drop, there are several operational drawbacks to finned-tube heat exchangers. For example, finned-tube heat exchangers have low heat transfer coefficients on large portions of the fins due to the development of thick boundary layers. Additionally, these heat exchangers have poor heat transfer in the wake or shadowed regions behind tubes as a majority of the gas flowing over a tube does not contact the backside of the tube or contact the portion of the fin surface that is shadowed by the tube.

In an attempt to increase the effectiveness of finned-tube heat exchangers, efforts have been made to vary the surface and overall geometry of the parallel fins to interrupt gas boundary layers or to make it more difficult for thick boundary layers to form on the fins. For example, finned-tube heat exchangers have utilized triangular or s-shaped wavy fins to enhance the heat transfer coefficient by disrupting boundary layer development and, also, by increasing the available heat transfer area. Alternatively, the surface geometry of flat, parallel fins can be enhanced, as is often done in refrigerant condensers, by slitting the fin three or four times in the areas of the fin between the tubes, thereby interfering with boundary layer development by creating offset surfaces on the fin that cause repeated growth and wake destruction of boundary layers. Another fin geometry sometimes used on the gas side of heat exchangers, but more often on the liquid side of heat exchangers such as automobile radiators, are accordion-like, louvered sheets that define parallel, triangular-shaped channels through which the gas flows. The formation of boundary layers is disrupted by the shape of the louvered-surface as the majority of the gas flows along the fin in the channel and also by the flow of a small amount of the gas through the louvers into adjacent channels.

U.S. Pat. No. 4,768,563 issued to Tsukamoto et al. discloses a finned-tube heat exchanger with corrugated and perforated fins that are arranged on staggered tubes so as to define parallel fluid channels across the tubes. The corrugated fins are positioned ridge to ridge and valley to valley so that the fluid channels have alternating expanding and contracting flow sections. This fin arrangement establishes differences in fluid pressures in the gas in adjacent fluid channels because expanding flow sections are positioned adjacent contracting flow sections. With this fin configuration, the main gas flow is along the parallel fluid channels, and boundary layer development on the fins is at least partially disrupted by the corrugated surfaces of the fins. Additionally, a small secondary flow is developed between adjacent fluid channels due to the differences in the fluid pressures in adjacent fluid channels causing a small portion of the gas to breathe or flow through the perforations into adjacent fluid channels and further disrupt the boundary layers.

U.S. Pat. No. 3,804,159 issued to Searight et al. discloses a pleated fin and tube cooling coil that attempts to use well-known jet impingement technology to enhance heat transfer on the back side of the fins. According to Searight et al. jet impingement on the back sides of the cooling fins is obtainable by forcing cooling gas through a small number of perforations in the fins at relatively high velocity to contact the backside of the adjacent fin. In this regard, Searight et al. uses low-porosity fins, i.e., less than 20 percent and preferably between 2 and 15 percent open fin area, to obtain high jet speeds when a large volume of gas is forced through a small number of holes and uses tightly spaced fins, i.e., 12 fins per inch, to allow the jets of gas to reach the adjacent fin. Additionally, the holes are relatively large in diameter, typically much greater than the thickness of the fin, to increase the jet size. Jet impingement requires careful staggering of the perforations on each adjacent fin so that jets strike adjacent fins between the perforations. While potentially increasing heat transfer on only the back sides of the pleated fins, the disclosed fin arrangement and design results in serious problems with high pressure drops caused by the close fin spacing and the low porosity of the fins. The resulting high pressure drop through the disclosed cooling coil significantly increases fan power requirements thereby lowering overall UA of the heat exchanger relative to a non-perforated, parallel fin heat exchanger.

While some of the above changes in the fin surface and fin shape may provide somewhat higher heat transfer coefficients in finned-tube heat exchangers, the UA of heat exchangers that include these enhanced fins remains relatively low. This low UA is, at least in part, due to ongoing problems with low heat transfer coefficients on the gas side and poor heat transfer in shadowed or wake regions behind the tubes. Further, many of the above design changes result in unacceptably large increases in pressure drop on the gas side of the heat exchanger that require increased expenditures on fan power.

Consequently, in spite of the well-developed state of heat transfer technology, there remains a need for a more effective gas-liquid heat exchanger that provides improved heat transfer capabilities while controlling operating and capital costs to make implementation cost effective for industrial and consumer applications.

SUMMARY OF THE INVENTION

Accordingly, it is a general object of the present invention to provide a gas-fluid heat exchanger with an increased UA value and improved ratio of UA to pressure drop.

It is a related object of the present invention to provide a gas-fluid heat exchanger with improved heat transfer properties on the gas side.

It is another related object of the present invention to provide a more effective gas-fluid heat exchanger that can be economically operated and manufactured with present technologies.

It is a more specific object of the present invention to provide a gas-fluid heat exchanger with an enhanced fin geometry and surface configuration that enhances heat transfer properties on the gas side of the heat exchanger.

Additional objects, advantages, and novel features of the invention are set forth in part in the description that follows and will become apparent to those skilled in the art upon examination of the following description and figures or may be learned by practicing the invention. Further, the objects and the advantages of the invention may be realized and attained by means of the instrumentalities and in combinations particularly pointed out in the appended claims.

To achieve the foregoing and other objects and in accordance with the purposes of the present invention, as embodied and broadly described herein, one preferred embodiment of the invention includes a fin and tube assembly for positioning in a gas flow path of a gas-fluid heat exchanger such that a gas is forced to flow through the fin and tube assembly to significantly increase the heat transfer surface area available (A) and the heat transfer coefficient (U) while also controlling any corresponding pressure drop. The fin and tube assembly includes fluid conduits, which are tubes in one embodiment, for directing a fluid through the heat exchanger and a heat transfer element in heat conductive contact with the fluid tubes to provide an extended heat transfer area between the fluid in the fluid conduits and the flowing gas. The heat transfer element is corrugated to have a cross-sectional shape of ridges and grooves with a heat transfer fin formed between each ridge and groove. The heat transfer element is positioned transverse to the gas flow path such that gas is forced to flow down along the fins from the ridges to the grooves in a flow channel.

The fins are highly porous, e.g., perforated, sintered, expanded, stabbed, built up from layers, and the like, to contain numerous orifices or pores to provide flow passages for the gas to transpire through the fins. Each of the interior surfaces of the orifices or pores contribute to the overall heat transfer surface area of the fin and tube assembly, which results in a significant increase in heat transfer surface area and a corresponding increase in the heat transfer rate of the fin and tube assembly. The grooves are closed or only partially open so that all or a substantial portion of the gas transpires through the orifices in the fins to provide an increased amount of heat transfer area including the interior surfaces of the orifices as well as the front and back surfaces of the fins and to establish desirable gas flow patterns that control boundary layer development and otherwise increase heat transfer rates within the fin and tube assembly. In a preferred embodiment, the fins are highly porous, i.e., 25 percent or considerably higher such as 50 to 70 percent or higher, with small sized holes, e.g., a diameter for a round hole of about the thickness of the fin, such that the interior surface area provides a large increase over nonporous fins, e.g., about a 25 percent or larger increase for higher porosities, in the available heat transfer surface area of the heat transfer element.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention. In the Drawings

DETAILED DESCRIPTION OF THE INVENTION

For liquid-to-gas, gas-to-liquid, and gas-to-gas heat exchangers, the present invention enhances heat transfer coefficients mainly by increasing heat transfer surface area while simultaneously maintaining a small boundary layer thickness over this area (and therefore, a higher heat transfer coefficient (U)) and minimizing the pressure drop. In this regard, heat transfer surface area is increased by forcing all of, or a significant fraction thereof, the cooling gas through highly porous (perforated, sintered, and the like) fins. The perforations can be considered analogous to short pipes, and the gas flowing through these "short pipes" is called an entrance flow region. In this entrance flow region (present at the edge of each perforation), the boundary layers are just beginning to develop and hence, are small which results in high heat transfer coefficients.

As will become clear from the following discussion, the use of highly porous fins, e.g., typically 25 percent or more open area on a fin, with small orifice size is in direct contrast to prior art devices but surprisingly, yields a significant increase in overall heat transfer surface area and a better control over pressure drops which often were unacceptably high in previous heat devices. This results in a significant increase in the heat transfer rate with a large amount of heat transfer occurring within the pores or holes in the fins. One embodiment of the present invention further provides an acceptable pressure drop through the porous fins, at least in part, by pleating or corrugating the fins to provide relatively wide flow channels, e.g., wide fin spacing, to allow the cooling gas to more readily flow through the channel but still slowing the velocity of the gas as it passes through the fins sufficiently to limit pressure drop. This pleating arrangement lowers the local gas velocity across each fin to lower the pressure drop. These and other features of the invention are discussed in the following discussion which first provides an illustration of a fin and tube assembly embodiment as used within a standard condenser and second, provides detailed descriptions of several embodiments of fin and tube assemblies that each enhances heat transfer surface area and the heat transfer coefficient with high-porosity fins while controlling pressure drops on the gas side.

Figure 1:
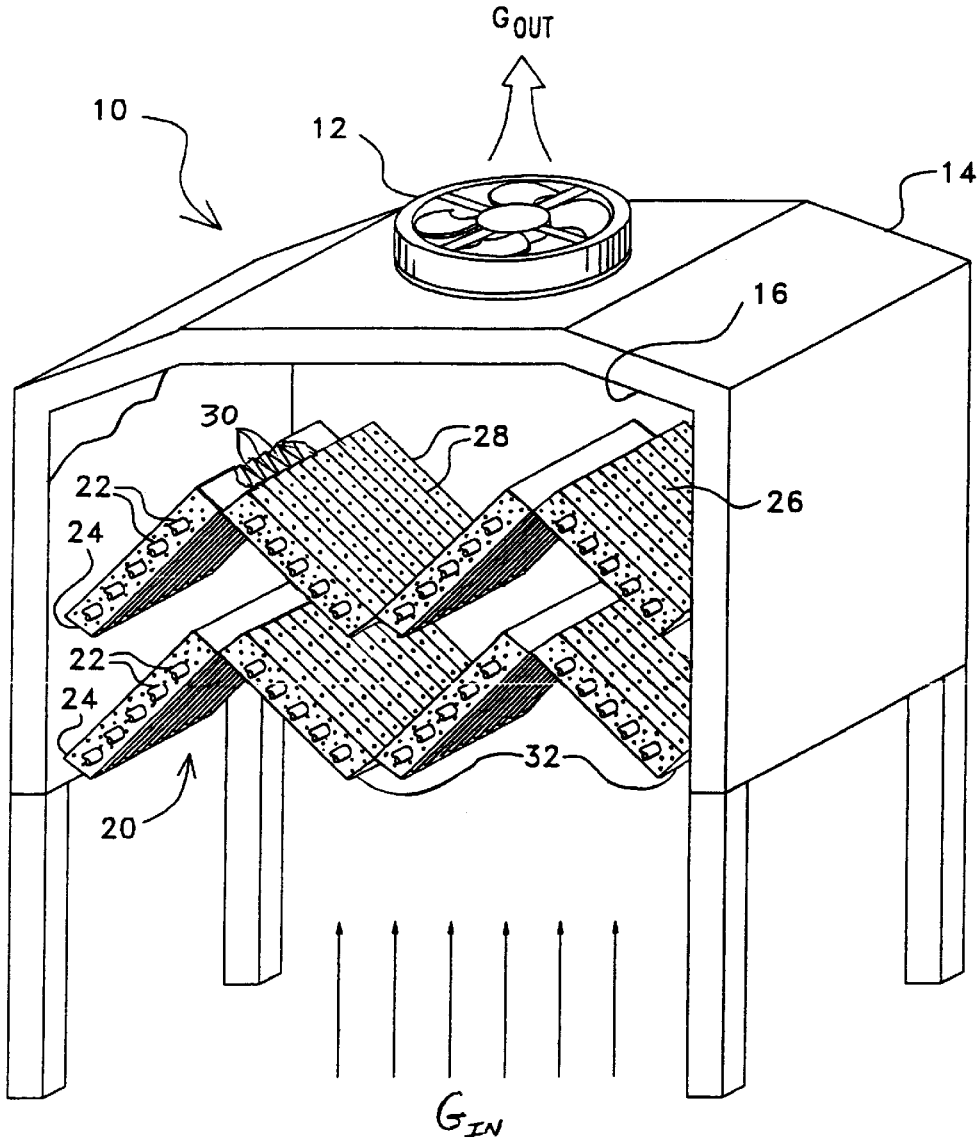
FIG. 1 is a partial perspective view of a condenser-type heat exchanger with a cutaway to reveal two fin and tube assemblies of the present invention in a nested configuration.
Figure 4A:
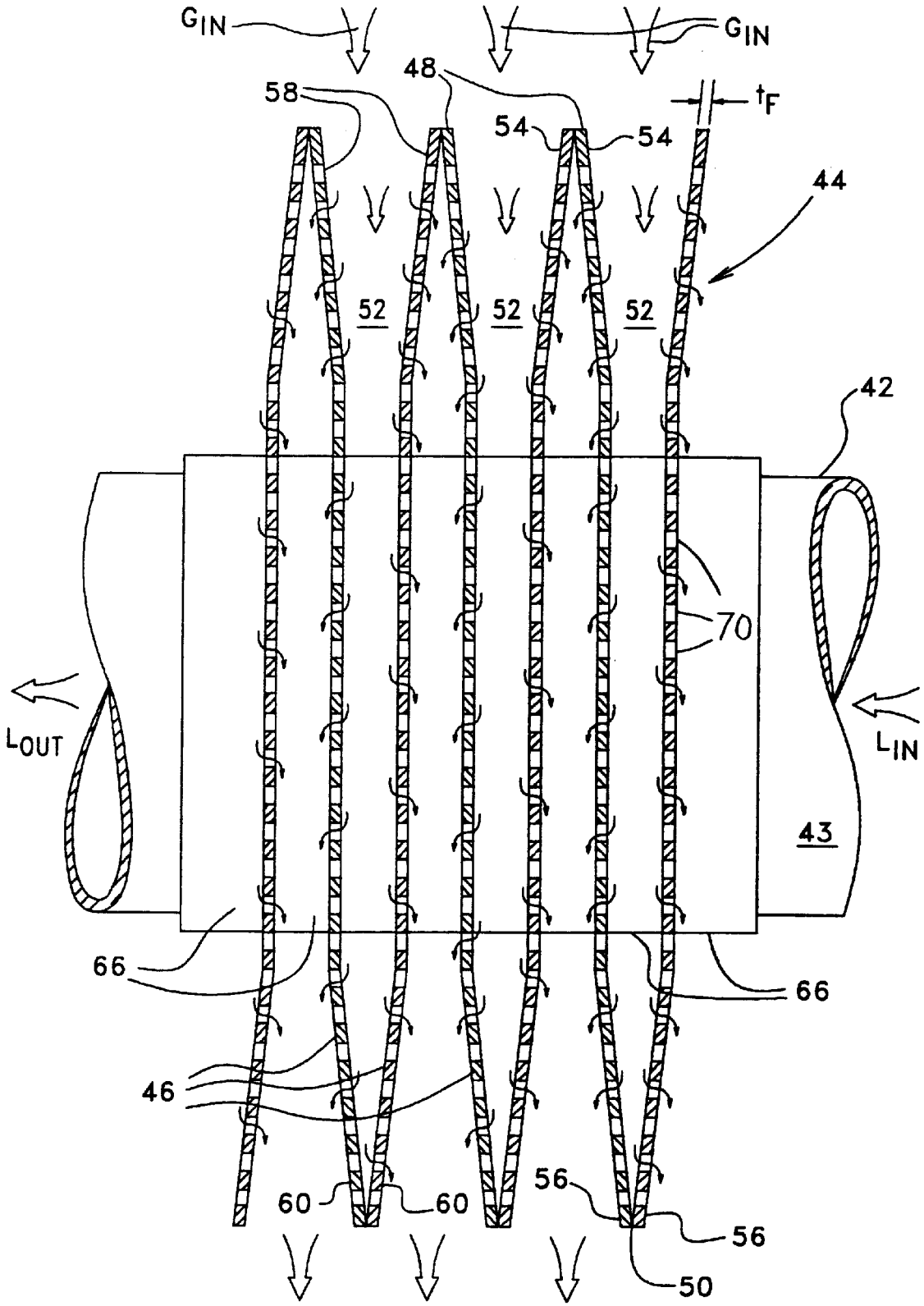
FIG. 4*a* is a sectional view of the fin and tube assembly of FIG. 3 taken along line 4*a*–4*a* illustrating the shape of a cross-section of a preferred embodiment of the fins.
Figure 4B:
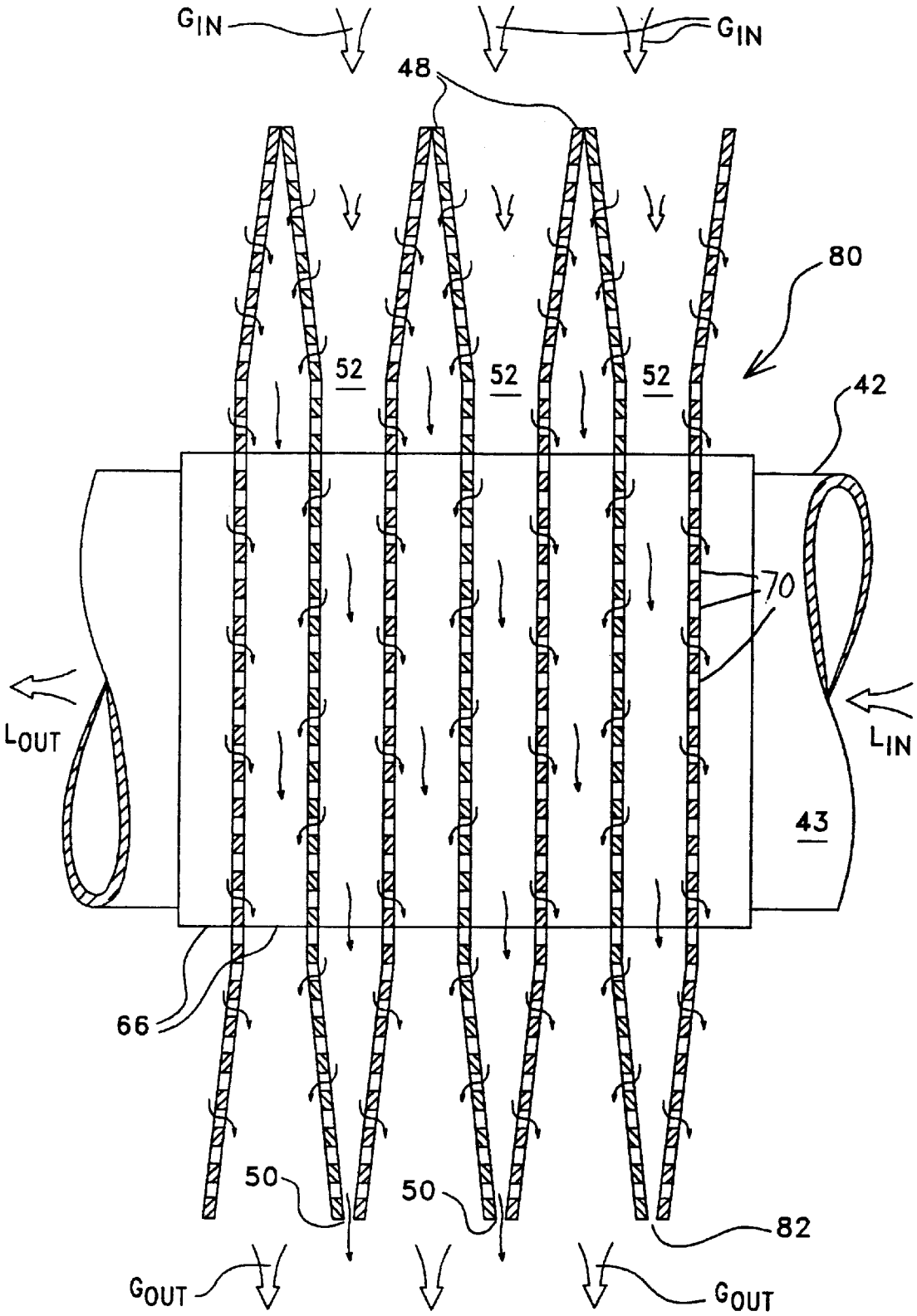
FIG. 4*b* is a sectional view similar to FIG. 4*a* illustrating the shape of a cross-section of another preferred embodiment of fins according to the present invention.
Figure 4C:
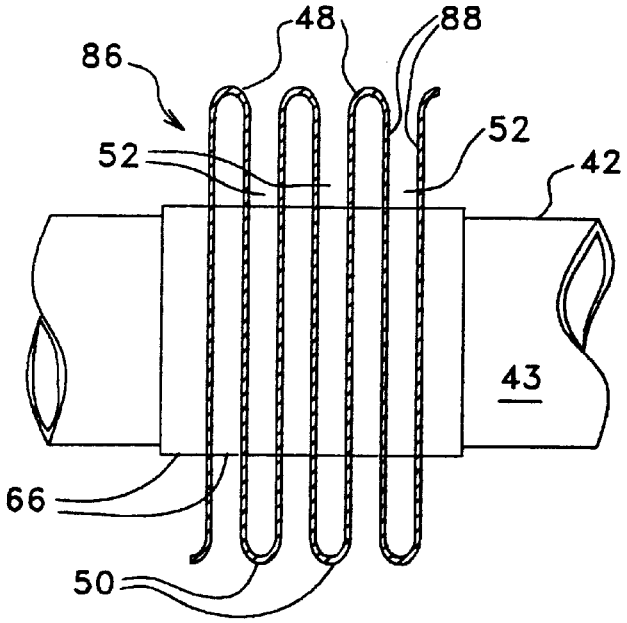
FIG. 4*c* is another sectional view similar to FIG. 4*a* showing the shape of a cross-section of yet another preferred embodiment of fins according to the present invention.
Figure 4D:
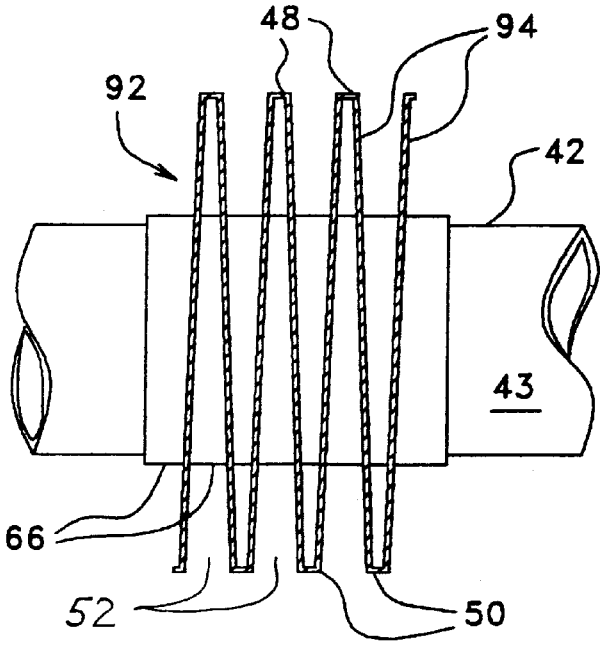
FIG. 4*d* is yet another section view similar to FIG. 4*a* showing the shape of a cross-section of still another preferred embodiment of fins according to the present invention.
Figure 4E:
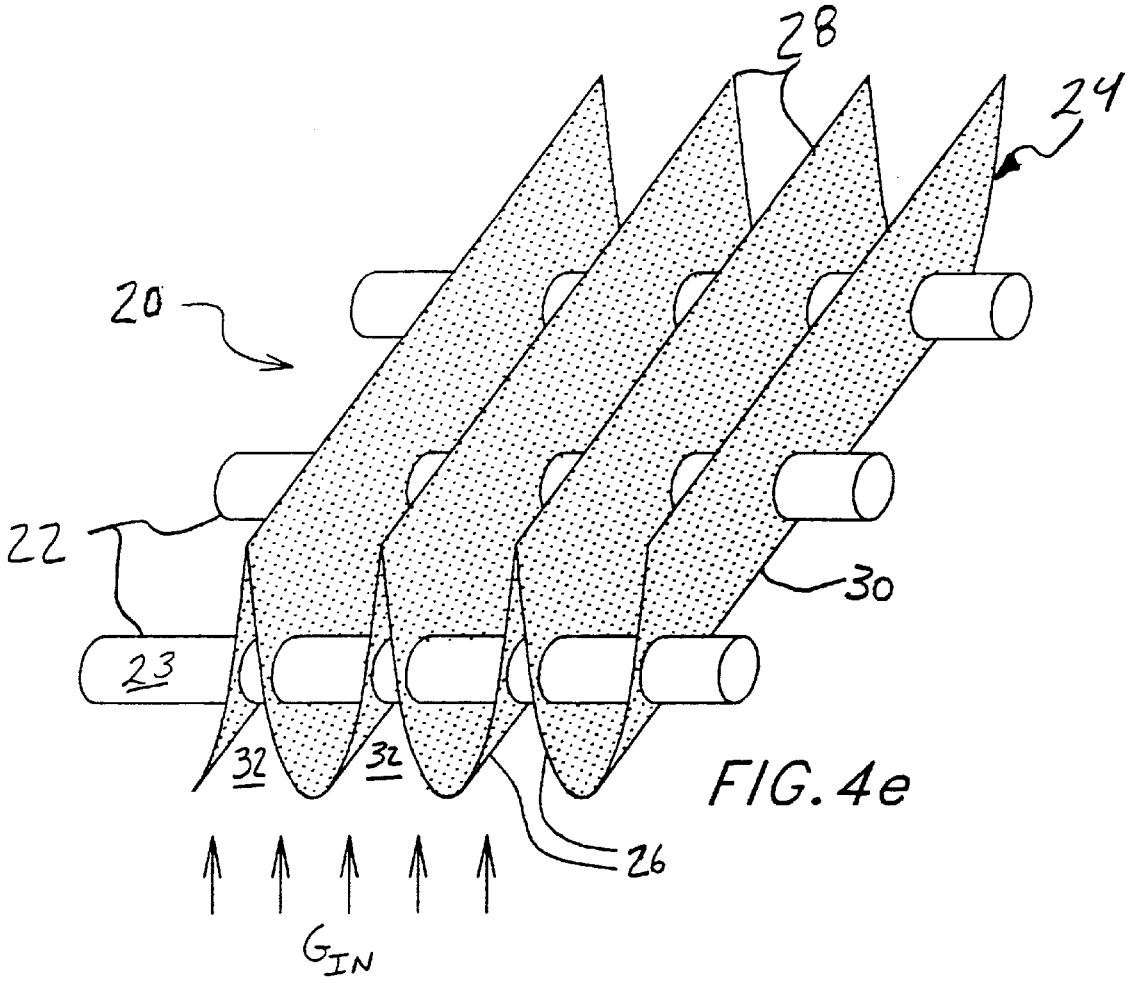
FIG. 4*e* is another section view similar to FIG. 4*a* showing the shape the fins of the fin and tube assembly of FIG. 1.

A heat exchanger 10 for use in exchanging heat between a gas and a single or multi-phase liquid according to the present invention is illustrated in FIG. 1. As shown, the heat exchanger 10 is a condenser-type heat exchanger with fan 12 for drawing a cooling gas, $G_{IN}$, into a housing a flow path defined by a hollow chamber 16, to cool a fluid (i.e., vapor, gas, or liquid) flowing through liquid conduits or tubes 22. The heated gas, $G_{OUT}$, is then exhausted out of the housing 14 through the fans 12. Heat transfer between the liquid and the gas occurs in the fin and tube assembly 20 which comprises rows of tubes 22 extending transversely through the hollow chamber 16 and also extending through, and heat-conductively contacting, two heat transfer elements or plates 24 (shown as an assembly of many porous fins 26, although other porous arrangements can be utilized) which function as extended heat transfer surfaces for the tubes 22. The heat transfer elements 24 are arranged as a nested, W-shaped pattern for ease of stacking and for providing space for a larger number of tubes 22, although many other shape patterns can be used with the present invention whether nested with a plurality of heat transfer elements 24 or not nested. Additionally, the top and bottom portions of each "fold" in the fin and tube assemblies 20 can be blocked to direct all of the flow through the flow fins 26 through flow paths 32. FIG. 4*e* illustrates a portion of a fin and tube assembly 20 and more clearly illustrates the flow paths 32 and porosity of the fins 26.

In this regard, according to an important aspect of the present invention, the heat exchanger is configured such that all or a substantial portion of the gas, $G_{IN}$, e.g., air, is forced to pass or transpire through fins 26 that are preferably highly porous, i.e., 25 to 80 percent or more open area. The inclusion of high-porosity, transpired fins 26 results in heat being more effectively transferred from the fins 26 because the gas, $G_{IN}$, contacts interior surfaces of the fins 26 as it passes through the fins 26, rather than merely flowing along exterior fin surfaces in parallel channels as in prior art heat exchangers, to increase the total heat transfer area and, as discussed in detail below, results in higher heat transfer coefficients on this larger total heat transfer area. Prior art heat exchangers typically direct cooling gases along parallel channels formed between heat transfer fins with heat transfer effectiveness being limited by the amount of exterior fin surface that contacts the gas and being further limited by the development of thick boundary layers along fin surfaces. In this manner, a large portion of the overall heat transfer in the present invention occurs within the holes or pores of the fins 26 which increases the invention's ability to exchange heat by significantly increasing the overall heat transfer surface area available.

According to the present invention, the heat transfer elements 24 are preferably regularly corrugated with a cross-sectional shape of alternating ridges 28 and grooves 30 with the heat transfer fins 26 being formed between each ridge 28 and groove 30. In FIG. 1, the spacing of the fins 26 shown is relatively large with less than one fin/inch for ease of clearly illustrating the heat transfer elements 24, but corrugation will typically be somewhat tighter such that the fin spacing is somewhat smaller or closer, for example, in the range of 1 to 10 fins/inch, to provide a larger total heat transfer area. To allow the gas, $G_{IN}$, to pass or transpire through the fins 26, the heat transfer elements 24 are preferably fabricated from thin sheet(s) of thermally conductive material, such as aluminum, steel, or copper, having numerous orifices or pores. The heat transfer elements 24 are positioned transverse to gas flow in the chamber 16 such that the incoming gas, $G_{IN}$, contacts the heat transfer element 24 at the ridges 28 and is guided along the fins 26 in flow channels 32 toward the grooves 30 with the gas, $G_{IN}$, transpiring through the orifices in the fins 26 at a substantially uniform flow rate from the ridges 28 to the grooves 30. The grooves 30 may be slightly open to reduce pressure drops in the heat exchanger 10 or fully closed as illustrated in FIG. 1 so that the fins 26 are fully transpiring. Additionally, although not shown, the ridges 28 may be open or spaced, alone or in combination with slightly open grooves 30 to control pressure drop or otherwise alter gas flow through the heat exchanger 10.

In general, these structural aspects of the heat exchanger 10 provide improved heat transfer characteristics by providing a significantly larger total heat exchange surface area and by controlling the thicknesses of developing boundary layers on the fins 26 and thereby increasing the heat transfer coefficient. The surface area available for heat exchange between the gas, $G_{IN}$, and the transpired fins 26 is significantly greater because the total heat transfer area includes interior surface areas of the orifices and also back or rear surfaces of the fins 26 in addition to the frontal surfaces of the fins 26, that provide the total heat transfer areas in most heat exchangers prior to this invention. The formation of boundary layers is effectively controlled in the heat exchanger 10 by directing the gas to flow through the many orifices on the fins 26 which minimizes boundary layer thickness by accelerating gas flow into and through the orifices, creating a stagnation point flow on the front surfaces of the fins 26 in locations between the orifices, and especially creating entrance flow conditions and characteristics at each orifice (similar to pipe entrance flow), i.e., thin boundary layers. The improved heat transfer rates of the heat exchanger 10 can be obtained with a single tube row through the fins 26, rather than as illustrated in FIG. 1, to further limit the amount of pressure drop occurring within the chamber 16 that must be overcome by the fans 12. These and other features and functional advantages of the present invention will be described in more detail below in connection with alternate embodiments of the invention.

Referring to FIGS. 2–6*c*, an embodiment of a fin and tube assembly 40 is illustrated that provides the functional advantages of the fin and tube assembly 20 of FIG. 1 while on a smaller scale, i.e., one row of three tubes with seven fins, that facilitates fuller description of the important structural features of the present invention, such as fin geometry, and of the gas flow patterns developed by the fin and tube assembly 40 which improve heat transfer characteristics. Further, it should be understood that although the fin and tube assembly 40 is illustrated as a standalone unit, in practice, the fin and tube assembly 40 would typically be positioned within a gas flow path of a heat exchanger such as the heat exchanger 10 shown in FIG. 1.

The fin and tube assembly 40 is useful for transferring heat between a fluid (e.g., a vapor, gas, or liquid), $L_{IN}$, and a gas, $G_{IN}$, more effectively than standard finned-tube heat exchanger devices of similar size. In this regard, the fin and tube assembly 40 includes fluid conduits 42 for carrying a fluid in, $L_{IN}$, and out, $L_{OUT}$, of the fin and tube assembly 40, and includes a highly porous heat transfer element 44, in heat conductive contact with the fluid conduits 42, through which a gas, $G_{IN}$, is passed or transpired prior to being exhausted, $G_{OUT}$, from the fin and tube assembly 40. The fluid conduits 42 provide a heat transfer path or surface between the fluid, $L_{IN}$, e.g., steam, water, vaporized or liquified hydrocarbons and refrigerants, and the like, and the gas, $G_{IN}$, e.g., air. The fluid conduits 42 are preferably fabricated from materials such as copper, aluminum, and steel that have a high thermal conductivity and are well-suited to many manufacturing and assembly techniques. The fluid conduits 42 can be formed with many cross-sectional shapes, for example, but not as a limitation, round, oval, or flat tubing, each of which is common in heat exchanger applications. As illustrated, the fluid conduits 42 are round tubes positioned transverse to the flow of the gas, $G_{IN}$, and have an exterior surface 43 which provides a heat transfer contact surface with the heat transfer element 44 and gas, $G_{IN}$, as it flows through and contacts the fluid conduits 42. Heat transfer can be further enhanced by the inclusion of heat conductive spacers 66 that are positioned about the periphery of the tubes 42 and which facilitate assembly of the heat transfer element 44, as will be described in further detail.

Figure 2:
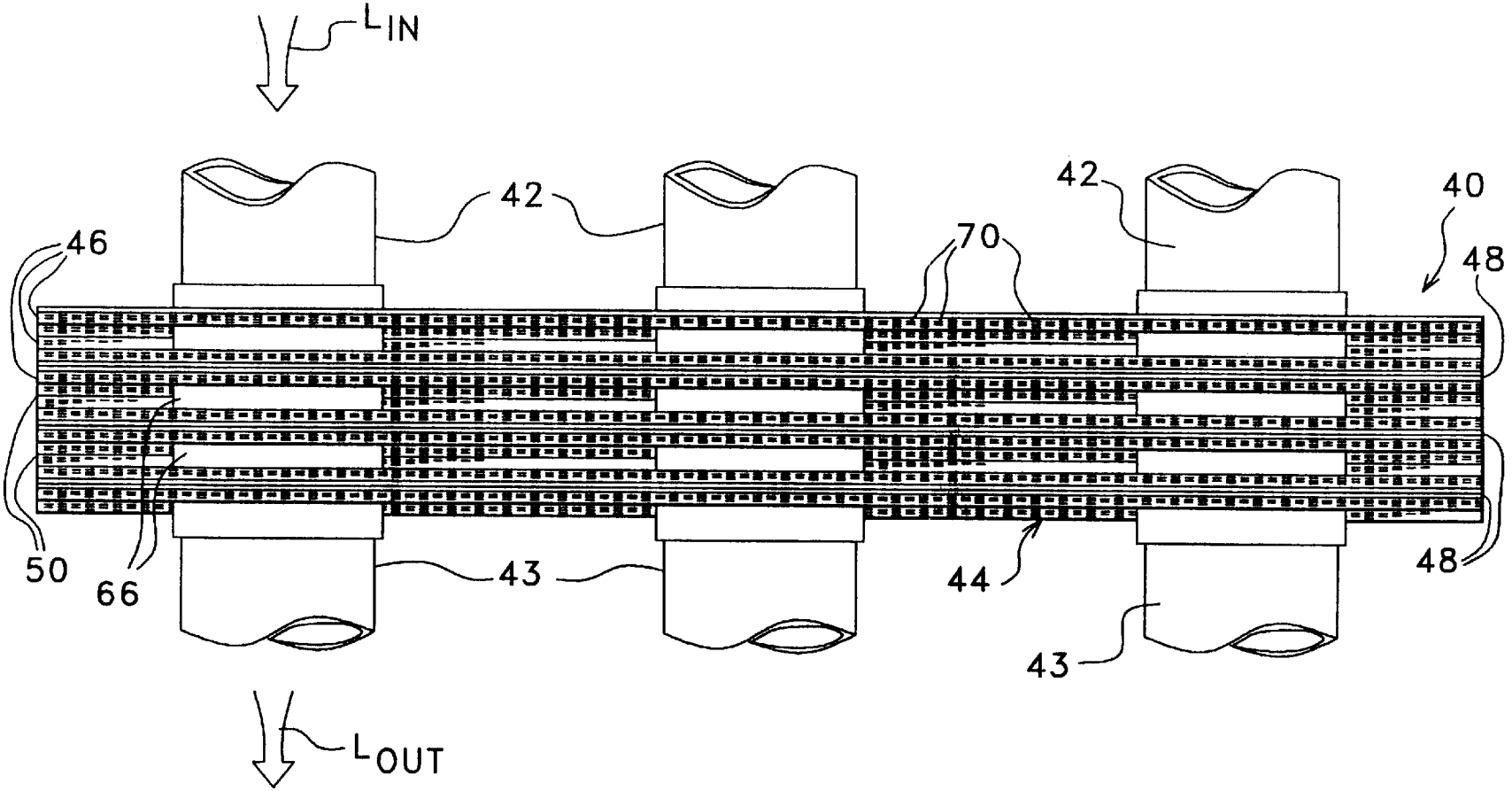
FIG. 2 is top view of a fin and tube assembly according to the present invention similar to the fin and tube arrangement of FIG. 1, having only one row of three tubes to simplify and clarify description of the present invention.
Figure 3:
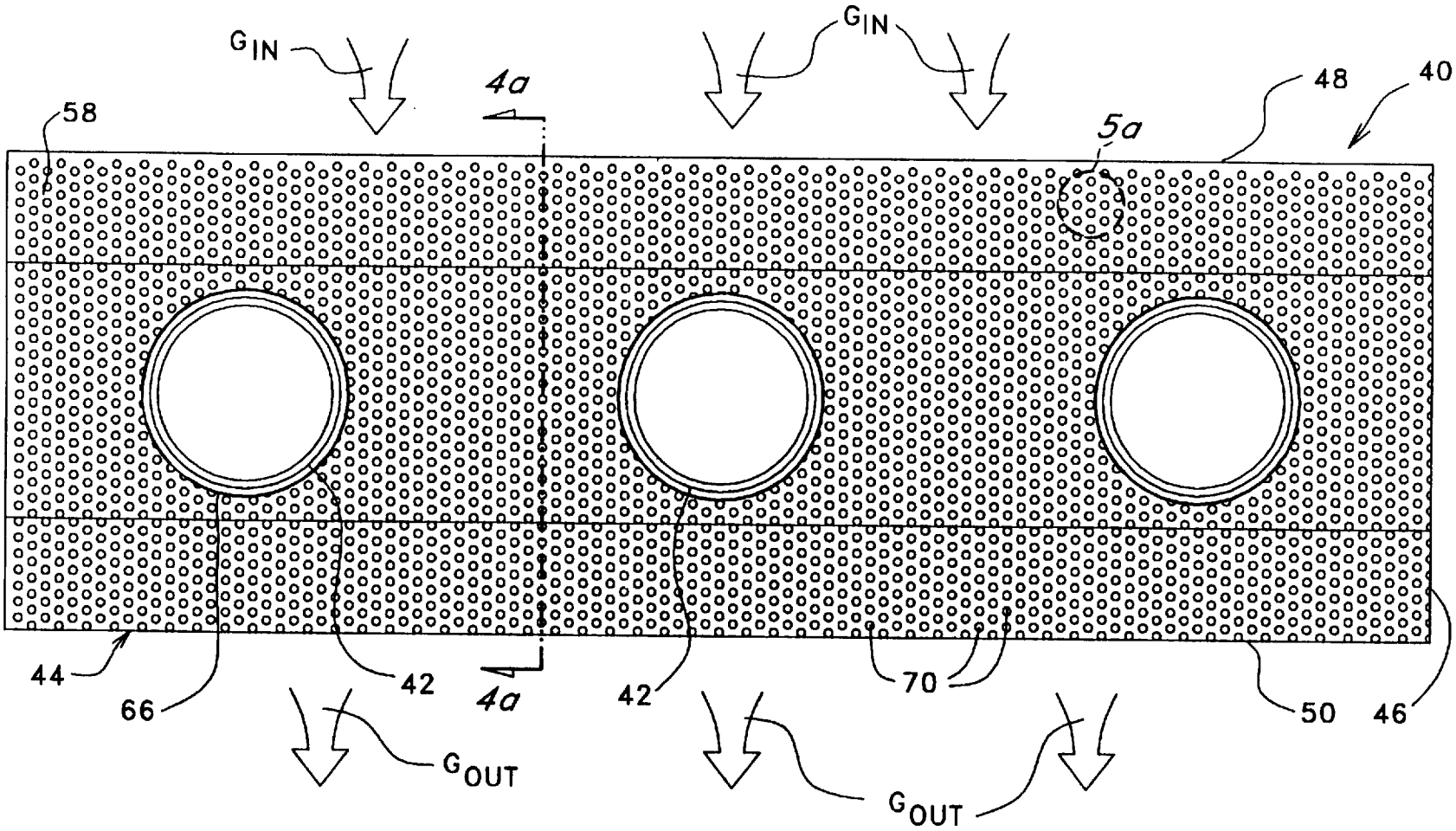
FIG. 3 is a side view of the fin and tube assembly of FIG. 2 illustrating the perforation of the fins.

According to an important aspect of the present invention, all or a substantial portion of the gas, $G_{IN}$, is forced to flow through the porous heat transfer element 44 to increase the surface area of the heat transfer element 44 that contacts the gas, $G_{IN}$, and to increase the heat transfer coefficient. In this regard, the heat transfer element 44 is positioned transverse to the flow path of the gas, $G_{IN}$, such that the gas, $G_{IN}$, makes a single pass through, rather than along, the heat transfer element 44. Referring to FIGS. 2, 3, and 4*a*, the heat transfer element 44 comprises a series of adjacent fins 46 with angled leading edges 54 in abutting contact that form ridges 48 and with angled trailing edges 56 in abutting contact that form grooves 50. FIGS. 4*c*, 4*d*, and 4*e* illustrate examples of alternate heat transfer elements 86, 92, and 20 with examples of different shaped fins 88, 94, and 26 respectively, that may be used in practicing the present invention to obtain a desired flow pattern (for example, relatively uniform flow), and, although not shown, numerous other corrugated fin shapes can be readily envisioned and are considered taught by this disclosure. Each fin 46 and 26 contains numerous pores or orifices 70 through which gas can transpire. Adjacent pairs of fins 46 and 26 form flow channels 52 and 32, respectively, in which gas, $G_{IN}$, flows as it passes through and exchanges heat with the heat transfer element 44 and 24.

Figure 5A:
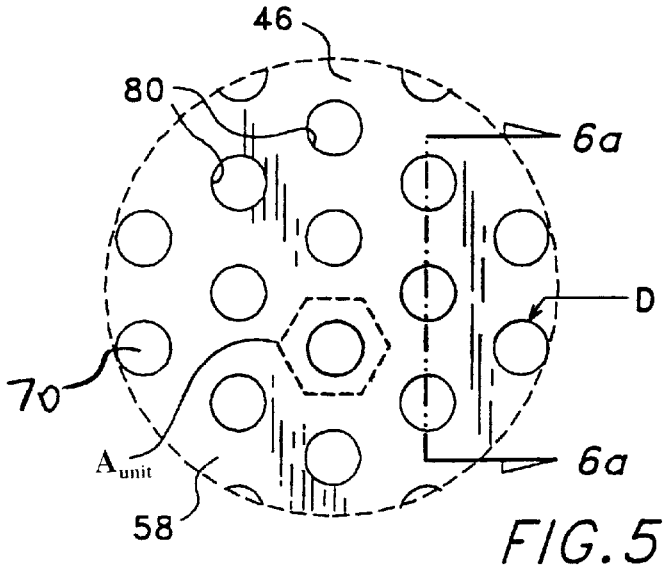
FIG. 5*a* is an enlarged partial view of the fin surface of FIG. 3 illustrating orifice shape.
Figure 6A:
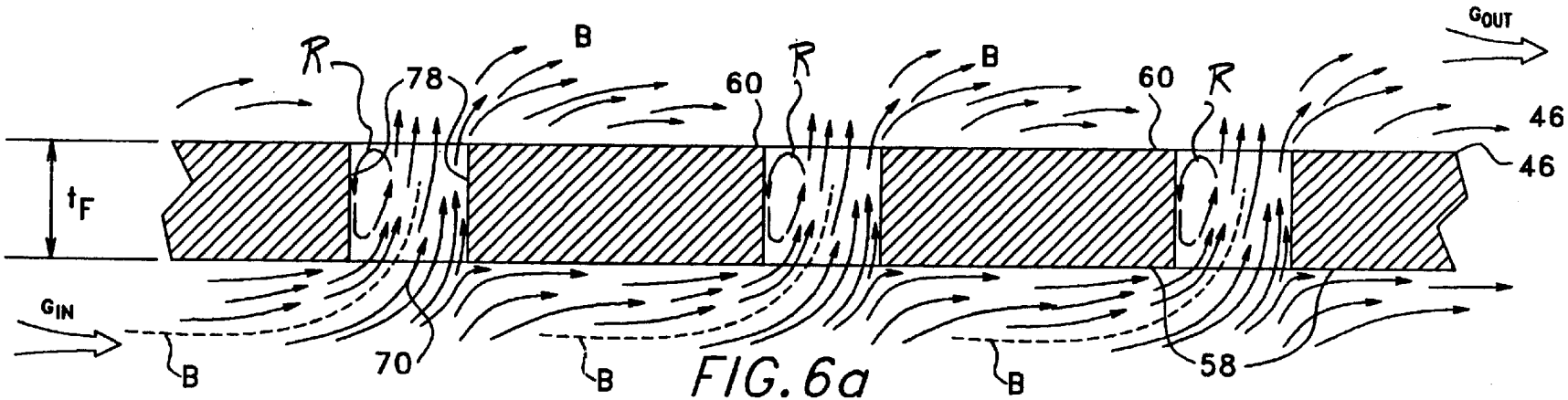
FIG. 6*a* is an enlarged sectional view of the fin portion illustrated in FIG. 5*a* taken along line 6*a*—6*a* to illustrate an interior orifice contact area.

The total heat transfer area provided by the heat transfer element 44, 24 includes a frontal contact surface 58 on each fin 46, 26 which faces the flow channels 52, 32, as is typically available and utilized in prior art devices. However, in addition to the frontal contact surfaces 58, by utilizing porous fins 46, 26 and by forcing transpiration through the fins 46, 26, the total transfer area is increased significantly by orifice contact areas 78 interior to every orifice 70, as illustrated in FIG. 6*a*. The amount of this increase in area depends on the number and size of the orifices 70 on each fin 46, 26 which can be quantified by determining the porosity of the fins 46, 26. Referring to FIG. 5*a*, the total surface area of a fin 46, 26 can be envisioned as consisting of numerous unitary areas, $A_{unit}$, which are made up, in this example, of the inside surface area of a circular orifice 70 and frontal contact surface 58 of the fin 46, 26 and a similar back contact surface (not shown). The porosity is determined by dividing the cross-sectional area of the orifice 70, which is based on the diameter, D, of the orifice 70, by the sum of orifice cross-sectional areas and the front contact surface area. Further, because it is generally desired to provide an improved heat transfer area and flow pattern to improve the heat transfer coefficient, it is desirable to employ a larger number of orifices 70 with smaller diameters, D, to achieve a desired porosity rather than a smaller number of orifices 70 with larger diameters, D, as is consistent with pressure drop considerations. In this regard, in one embodiment of the invention, the diameter, D, of the orifice 70 is approximately equal to or less than the thickness, $t_F$, of the fin 46, 26 material and the fin 46, 26 has a uniform thickness, $t_F$. Additionally, although the illustrated fins 46, 26 have orifices 70 of uniform size, shape, and spacing, the present invention can readily be practiced with each fin 46, 26 having orifices 70 of differing size, shape, and/or spacing and the fin 46, 26 can be fabricated with a varying fin thickness, $t_F$.

As will be understood by those skilled in the art, while a high-porosity fin is desirable, myriad porosities can be used to practice the present invention. For example, the porosity of the fins 46 may be very high, e.g., 70 percent or higher, which may be desirable to maximize hole heat transfer area. On the other hand, the porosity may be lower to maintain fin heat conductance or to allow the use of readily available fin materials, such a lower porosity may be about 50 percent or less, and in one embodiment, a porosity of about 28 percent has been found useful for providing a large heat transfer area inside the orifices 70 using off-the-shelf materials. The fins 46, 26 are illustrated with substantially uniform porosity or orifice 70 density, but it may be desirable to vary (e.g., with distance from the tubes 42 or circumferentially about the tubes 42) the density of the orifices 70 and/or the sizes of the orifices 70 at different locations on the fins 46, 26 to obtain a more preferable heat transfer rate by further controlling flow patterns of the gas, $G_{IN}$, and to take advantage of the higher heat transfer rate near the tubes 42, 22. Alternatively or additionally, it may be desirable to vary the thickness, $t_F$, of the fins 46, 26 to better control heat conductance and/or heat transfer.

Further, the increase in total heat transfer area due to the orifice contact areas 78 is dependent on the thickness, $t_F$, of the fins 46, 26. As with selection of fin porosity, a wide range of fin thicknesses, $t_F$, can be used to practice the invention and will typically vary depending on the material, such as aluminum, copper, or steel, used in fabricating the fins 46, 26 and on limitations of particular fabrication methods employed. For example, but not as a limitation, in one embodiment, the fins 46, 26 are fabricated from aluminum sheets that are about 0.03 inches thick. With such a fin thickness, $t_F$, porosity (i.e., about 30 percent), and orifice 70 diameter, D, (i.e., equal to about the fin thickness, $t_F$, of about 0.03 inches), the combined orifice contact surfaces 78 of the orifices 70 represents about a thirty percent increase in the heat transfer surface area available due to the orifice contact surfaces 78 and the frontal surface 58 and back surface of the fins 46, 26, when compared with a fin with no orifices. This represents a large increase in contact area over nonporous fins; in the above example, approximately 46 percent of the heat transfer surface area is located inside the orifices 70. Similarly, because the orifice contact surface 78 for a fin 46, 26 with orifices 70 having diameters, D, of about the thickness, $t_F$, of the fin 46, 26 is four times the cross sectional area of the orifice 70 and is twice the heat transfer area removed from the frontal and back surfaces of the fin 46, 26, such a fin 46, 26 with a porosity of fifty percent would have fifty percent more total surface area available for heat transfer. Clearly, the use of a transpired, highly porous heat transfer element 44, 24 in the flow path of the gas, $G_{IN}$, provides a larger total heat transfer area (A) and heat transfer coefficient (U) in the fin and tube assembly 40, 20 and as discussed earlier, a larger UA value relative to overall volume is desirable for enhancing performance of heat exchangers.

According to another important aspect of the present invention, boundary layer development and flow patterns of gas, $G_{IN}$, flowing into and through the fin and tube assembly 40 are uniquely controlled to provide a more effective heat exchanger with an improved, i.e., higher, overall heat transfer coefficient. As discussed above, the control of boundary layer development is beneficial because local heat transfer coefficients are highest where boundary layers are thinnest, such as at the entrance region of a tube or pipe, and decrease rapidly with increasing boundary layer thickness. Additionally, controlling flow patterns of the gas, $G_{IN}$, can increase local heat transfer coefficients by, for example, disrupting boundary layer development on the fins 46 and creating a stagnation point flow of the gas, $G_{IN}$, on front-surface portions of the fins 46 because stagnation point flow on a surface typically increases heat transfer rates at that location. In this regard, FIGS. 4*a* and 6*a* illustrate the flow patterns and development of boundary layers, B, on fins 46 having circular orifices 70. As the gas, $G_{IN}$, flows in the flow channels 52 it contacts frontal surfaces 58 on the fins 46 and is directed within flow channels 52 toward the closed grooves 50. As the gas, $G_{IN}$, flows along the fins 46 some portion passes or transpires through each orifice 70 (with some flow separation and corresponding recirculation region, R, on the upstream side of the orifice 70). The transpired gas flows along and exchanges heat with the inside edge of the hole and with the back surface 60 of each fin 46 until the gas, $G_{OUT}$, is exhausted from the heat transfer element 44. In one embodiment, the heat transfer rate is substantially equivalent along each fin 46 due, at least in part, to substantially uniform gas flow through the orifices 70 along each fin 46. Clearly, however, the gas flow can be nonuniform through the orifices 70 to achieve the higher heat transfer rate benefits of the invention. For example, but not as a limitation, a nonuniform flow rate of the gas, $G_{IN}$, may be desirable through orifices 70 in proximity to the tubes 42, e.g., faster flow in orifices 70 nearer the tubes 42 to increase heat transfer. Additionally, it may be desirable that the porosity be otherwise varied to control flow and heat transfer, as discussed above.

Boundary layer, B, control is best understood by referring to FIG. 6*a*. Boundary layers, B, begin to thicken along the frontal surface 58 of the fins 46 between orifices 70 but become thin at the entrance of the orifices 70 as gas, $G_{IN}$, accelerates through the orifices 70. Additionally, the heat transfer rate within each orifice 70, on the orifice contact surfaces 78, is relatively high because the fins 46 have small thicknesses, $t_F$, that make boundary layer, B, development difficult leading to thin boundary layers, B. The heat transfer rate within the orifice is increased because each hole acts like the entrance region of a tube or pipe and boundary layers do not have an opportunity to grow very thick before the exit of the hole. Further, flow stagnation occurs on the frontal surface 58 of the fins 46 in locations adjacent rows of the orifices 70 due to gas entrance near the orifices 70. Some impingement of the "jets" exiting the orifices 70 can also occur on the back sides 60 of the fins; however, the present invention is not designed to maximize this effect, focusing instead on the heat transfer interior to the fins 46. In the above manner, the overall heat transfer coefficient for the fin and tube assembly 40 is much improved compared to prior art heat exchanger devices due to improved local heat transfer coefficients resulting from limited boundary layer development and creating desirable flow patterns.

Figure 6B:
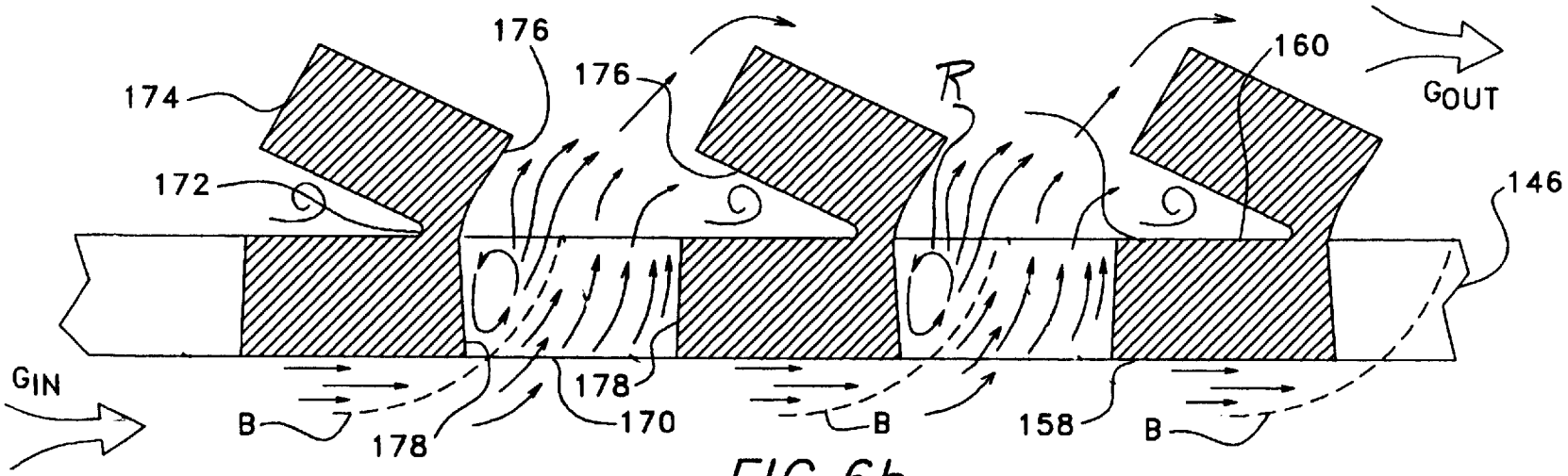
FIG. 6*b* is a sectional view similar to FIG. 6*a* illustrating an alternate orifice contact area of the present invention.
Figure 6C:
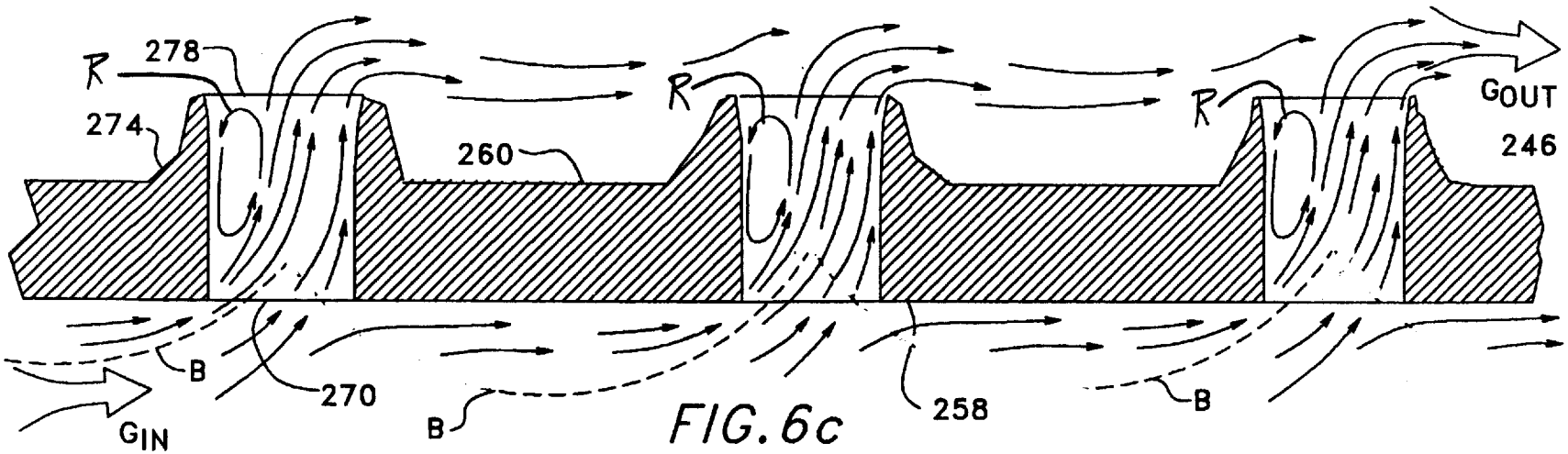
FIG. 6*c* is another sectional view similar to FIG. 6*a* illustrating another alternate orifice contact area of the present invention.

Many methods may be used to fabricate porous fins according to the present invention and as illustrated in FIGS. 6*a*–6*c*. If a method of cutting or perforation is used that completely and cleanly removes material is employed, a fin 46 as shown, and as discussed above, is fabricated. It may be preferable that this fabrication method be varied slightly to leave the displaced material attached as illustrated in FIG. 6*b*. Fin 146 can be fabricated by cutting almost completely through a metal sheet about the periphery of each formed orifice 170 but leaving hinge material 172 to allow the removed material 174 to be pushed toward the back surface 160 of the fin 146. The hinge material 172 can be located at any point on the periphery of the orifice 170, including the frontal surface 158, or a combination thereof, i.e., some on the frontal surface 158 and some on the back surface 160 and some hinged upstream, some hinged cross-stream, and some downstream. Further, at least a part of the removed material could be used to form shaped louvers on the frontal surface 158 and/or the back surface 160. One useful location is the one illustrated in FIG. 6*b* which allows the removed material 174 to be hinged upward. In this manner, alternate fin 146 may have a higher UA value than fin 46 because it provides a larger contact area for heat transfer with extended heat transfer surface 176 being added to orifice contact surface 178. On the other hand, although not shown, it may be desirable that all of the removed material 174 be pressed against the back surface 160 on the downstream side of the orifice 170 to better control pressure drops in the fin 146. Alternatively, orifices 270 can be formed by punching, stabbing, or extrusion that forms a frustaconical shaped orifice contact surface 278 as shown for fin 246 in FIG. 6*c* (shown with smooth surfaces for simplification but stabbing of a thin metal sheet may likely result in a more dramatically flared, rough and/or torn removed material 274). Fin 246 provides an advantageous increase in the size of the orifice contact surface 278 and also retains any material 274 removed from the orifice 270 to make this material 274 available for heat transfer and also for disrupting boundary layer, B, development on the back surface 260 of the fin 246. Also, all of these configurations can be oriented such that the additional material is on the upstream side of the fin (not shown). This alternate orientation can provide the advantage of directing the incoming gas into the orifices 70, thus reducing pressure drop.

Figure 5C:
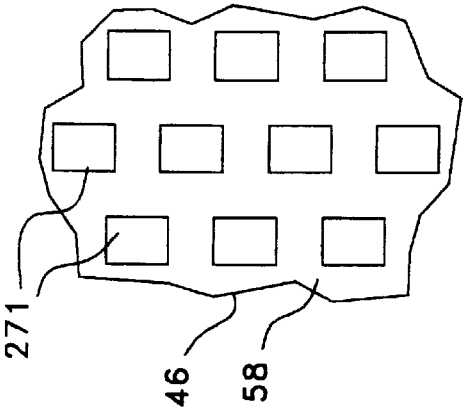
FIG. 5*c* is another view similar to that of FIG. 5*a* illustrating another alternate orifice shape of the present invention.
Figure 5B:
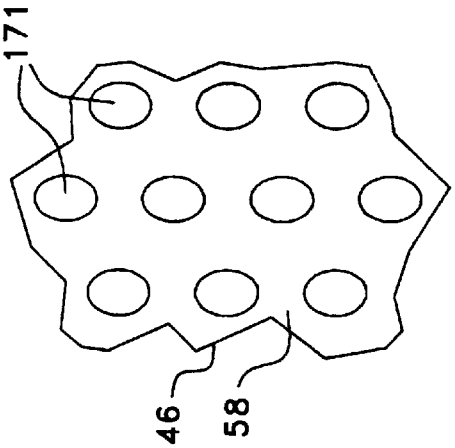
FIG. 5*b* is a view similar to that of FIG. 5*a* illustrating an alternate orifice shape of the present invention.

It is also important that the fin and tube assembly 40 be configured to control the amount of pressure drop between the incoming gas, $G_{IN}$, and the exhausted gas, $G_{OUT}$, because it is typically preferable that increases in operating costs, i.e., increased fan power, resulting from a new heat exchanger design are offset by increases in heat transfer effectiveness. One method of controlling the pressure drop is through selection of the orifice size and shape. As discussed above, the inventors recognize that from the standpoint of increasing heat transfer a smaller sized, e.g., small diameter, orifice is generally preferable over larger orifices for meeting the design goal of providing increased heat transfer surface area, i.e., inside surfaces of each orifice while still providing high porosity. FIGS. 5*a*–5*c* show preferred shapes, i.e., round, oval, and polygonal for the orifices 70, 170, and 270, respectively, to limit pressure drop across the fins 46 and, although not shown, orifices can be formed as slits, louvers, and the like or any combination of the above. To allow comparison of the size of these non-circular holes, the size of any hole can be described by its hydraulic diameter, which is defined as four times the ratio of the cross-sectional hole area to the perimeter of the hole. Another method of controlling pressure drop is to transpire a substantial portion of the gas, $G_{IN}$, flowing across the heat transfer element 44 while allowing at least a small portion to flow relatively straight through the heat transfer element 44. In this regard and referring to FIG. 4*b*, an alternate heat transfer element 80 is shown with a small space 82 in each groove 50 to provide a path for the gas, $G_{OUT}$, to flow without being transpired. Although not shown, the alternate heat transfer element 80 could be further modified to have small spaces in each ridge 48 to further control pressure drops, and additionally, the use of such small spaces can be employed in any number of combinations.

Pressure drop can further be controlled through selection of a relatively low fin density, e.g., a fin density of 10 fins or less per inch, with the pressure drop generally increasing with higher fin densities. Note, this geometry of the invention can also be described in terms of fin pitch which is a measure of the spacing between adjacent fins, with higher fin pitch being preferred to reduce pressure drop in the invention. Generally, there is a preferred fin density that should be utilized to minimize overall pressure drop, but as discussed earlier, many different fin densities can be used to practice the present invention. In one embodiment, the fin density is between 3 fins and 10 fins per inch and, for the prototype tested by the inventors, about 7 fins, per inch to obtain a high heat transfer surface area. In another preferred embodiment, a lower fin density, i.e., less than 3 fins per inch, is employed to reduce pressure drop by widening the channels and reducing channel pressure drop. This is particularly desirable when thicker fins 46 are used to provide a larger interior contact surface 78, and such thickness can be achieved by fabricating fins 46 from thicker sheets of heat-conductive material and/or by layering thinner fins 46 together. As will be discussed in more detail below, preferred embodiments of the present invention include fins 46 with thicknesses, $t_F$, of ¼-inch, ½-inch, and higher. The fin shape can also provide control over pressure drop; for example, the parabolic fins 26 shown in FIG. 4*e* are an example of the use of Bernoulli's flow principles can be used to control gas flow within the channel 32, and thereby influence the gas flow through the fins 26 and the pressure drop through the system, by increasing the velocity of the gas and reducing its static pressure as it flows from the beginning to the end of the channel 32. Parabolic-shaped fins 26 are used to increase the uniformity of the gas flow through the fins 26, which results in an overall reduction of pressure drop Of the gas. Further, in this regard, numerous other curved shapes will be apparent to those skilled in the art and can be used for the fins 26, such as, for example, circular, sine, and myriad other curves.

To maintain low fabrication costs, the fin and tube assembly 40 of the present invention can be readily fabricated with well-known methods. One well-known method is mechanical expansion of tubing to provide a tight fit with fins that have been slid over the tubing. For example, referring to FIGS. 3 and 4*a*, each fin 46 of the heat transfer element 44 can be formed from a separate sheet of thin metal that has been perforated to provide the orifices 70. The fin 46 is bent at each end to provide angled leading and trailing edges 54 and 56, respectively, and a hole through which the tube 42 can be slid is cut in the fin 46 with a diameter slightly larger than the initial outer diameter of the tube 42. To assemble the heat transfer element 44, spacers 66 and fins 46 are alternately slid onto the tube 42 with leading edges 54 and trailing edges 56 of adjacent fins 46 in abutting contact. The tube 42 can also be pressurized to cause the tube 42 to expand outward to provide a tight fit and an excellent contact surface between the fins 46 and spacers 66 and exterior surface 43 of the tube 42. Alternatively, the spacers 66 could be omitted and the tube 42 expanded directly to the fins 46. The fins 46 are substantially perpendicular to the tube 42 where the tube 42 passes through the fins 46 for ease of fabrication and of providing a tight fit with spacers 66. Alternatively, other corrugation shapes can be employed in the present invention such as those shown in FIGS. 4*c*, 4*d*, and 4*e*. In FIG. 4*c*, an alternate heat transfer element 86 is shown that has S-shaped fins 88 that form rounded ridges 48 and grooves 50 and U-shaped flow channels 52. In FIG. 4*d*, an alternate heat transfer element 92 is shown with fins 94 that produce flattened ridges 48 and grooves 50 and partial-hexagonal shaped flow channels 52. In FIG. 4*e*, an alternate heat transfer element 20 is shown with parabolic-shaped fins 26 that produce ridges 30 and relatively sharply pointed grooves 28 and somewhat circular, V-shaped flow channels 32. This has the potential advantage of providing more uniform flow across the fins 26. Other corrugation configurations and fin shapes can be envisioned, with implementation in the present invention only being limited by manufacturing abilities and costs. For example, a single sheet of thin metal may be perforated and then corrugated by well-known bending and forming methods to form a one-piece heat transfer element with multiple fins. Alternatively, it can be envisioned that fins and heat transfer elements can be formed from porous materials, such as, for example, expanded, sintered, stabbed, or layered materials, that provide desired porosities and could be formed into useful shapes, as long as heat conductive properties are maintained with such porous materials.

Figure 7:
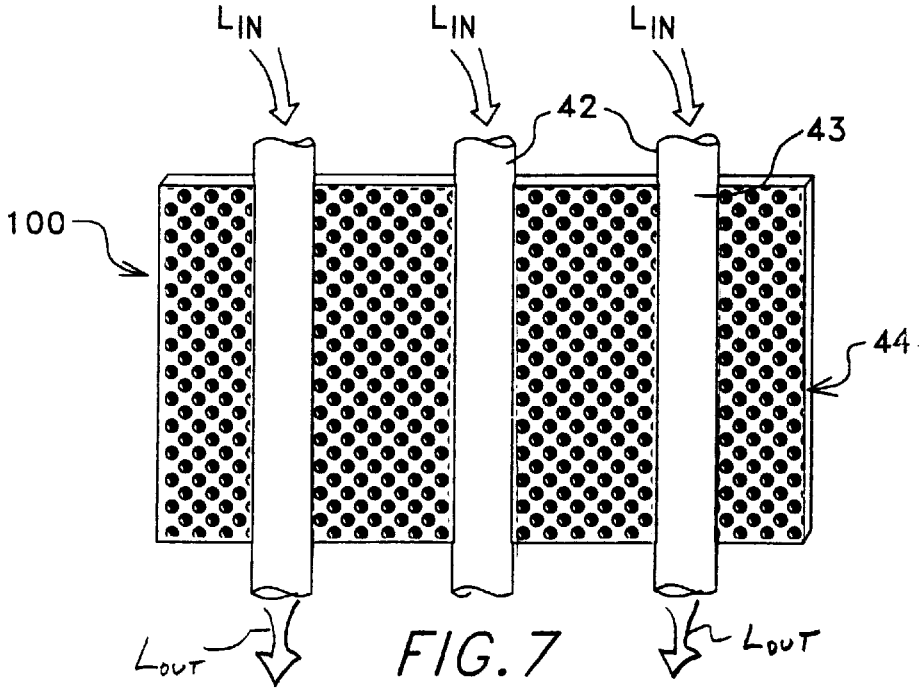
FIG. 7 is a top view similar to FIG. 2 illustrating an alternate fin and tube assembly of the present invention having a thick fin.
Figure 8A:
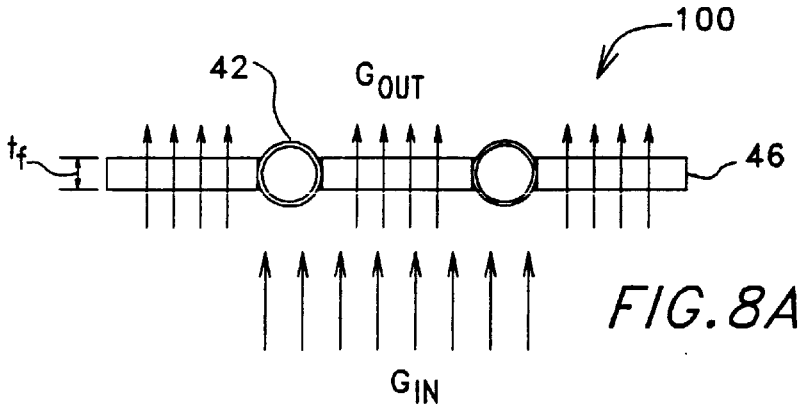
FIG. 8*a* is a sectional view of the fin and tube assembly of FIG. 7 taken along line 8—8.

The functional advantages of the present invention are not limited to fluid conduits that pass through heat transfer elements but expressly include configurations in which the fluid conduits continuously (or otherwise) abut or lie on the heat transfer element along the length of the fluid conduits to provide a heat transfer path. Referring to FIGS. 7 and 8*a*, a fin and tube assembly 100 is illustrated that utilizes heat transfer element 44 but positions tubes 42 at the ends of the fins 46, i.e., a "tube-in-fin" or a "tube-on-fin" configuration. The inventors recognize that fin and tube assembly 100 can be configured for high performance by increasing the thickness, $t_F$, of each fin 42 up to ¼-inch, ½-inch, and higher. This increased fin thickness, $t_F$, works to increase heat transfer surface area, assuming similar porosities and orifice size, both constant and variable sizing, as discussed earlier, and in many cases the orifice diameters (for circular orifices) would be much less than the fin thickness, $t_F$. As illustrated in FIG. 8*a*, the flow channels are eliminated in this embodiment, and the cooling gag, $G_{IN}$, flows through the porous fins 4s. Ag discussed earlier, the invention takes unique advantage of the large amount of heat transfer within the holes themselves rather than merely on the fin outer surfaces. Thick fins are also desirable because of an improved ratio of heat transfer to pressure drop across the fin because the thick fin does not increase the pressure drop terms associated with gas entering and leaving each hole.

Figure 8B:
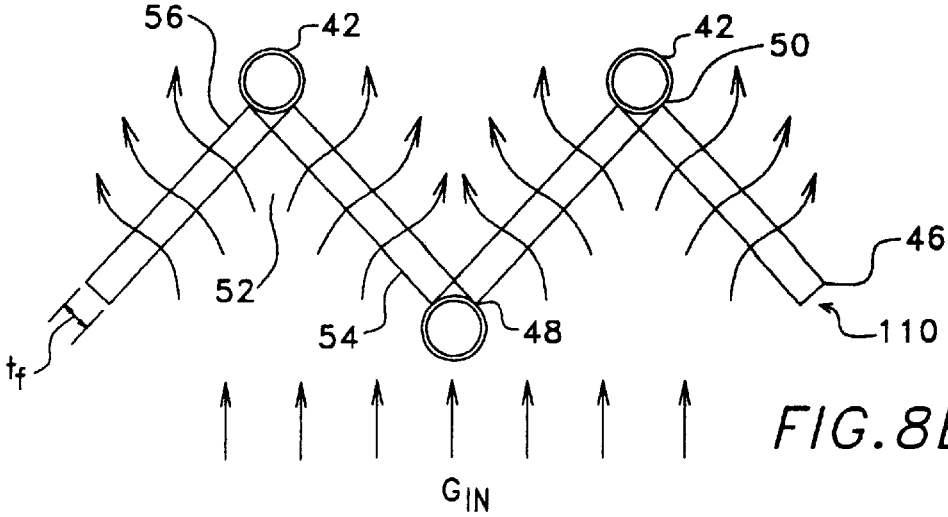
FIG. 8*b* is a sectional view similar to FIG. 8*a* illustrating another embodiment of the alternate fin and tube assembly of FIG. 7.

In another desirable configuration, the flow channel 52 is simply made relatively wide with a relatively large fin spacing, such as less than about 1 fin/inch, as illustrated in the fin and tube assembly 110 illustrated in FIG. 8*b*. Although not shown, the tubes 42 could also be placed on the back surface of the fins 46 to achieve excellent heat transfer rates or inside the flow channels 52 being mounted directly to the front surface of the fins 46. Similarly, the tubes 42 in the embodiments of FIGS. 8*a* and 8*b* are transverse to the path of the gas, $G_{IN}$, but it may be preferable that the tubes are positioned such that the liquid, $L_{IN}$, flows parallel to the gas, $G_{IN}$, to develop beneficial temperature differentials (not shown).

Figure 9:
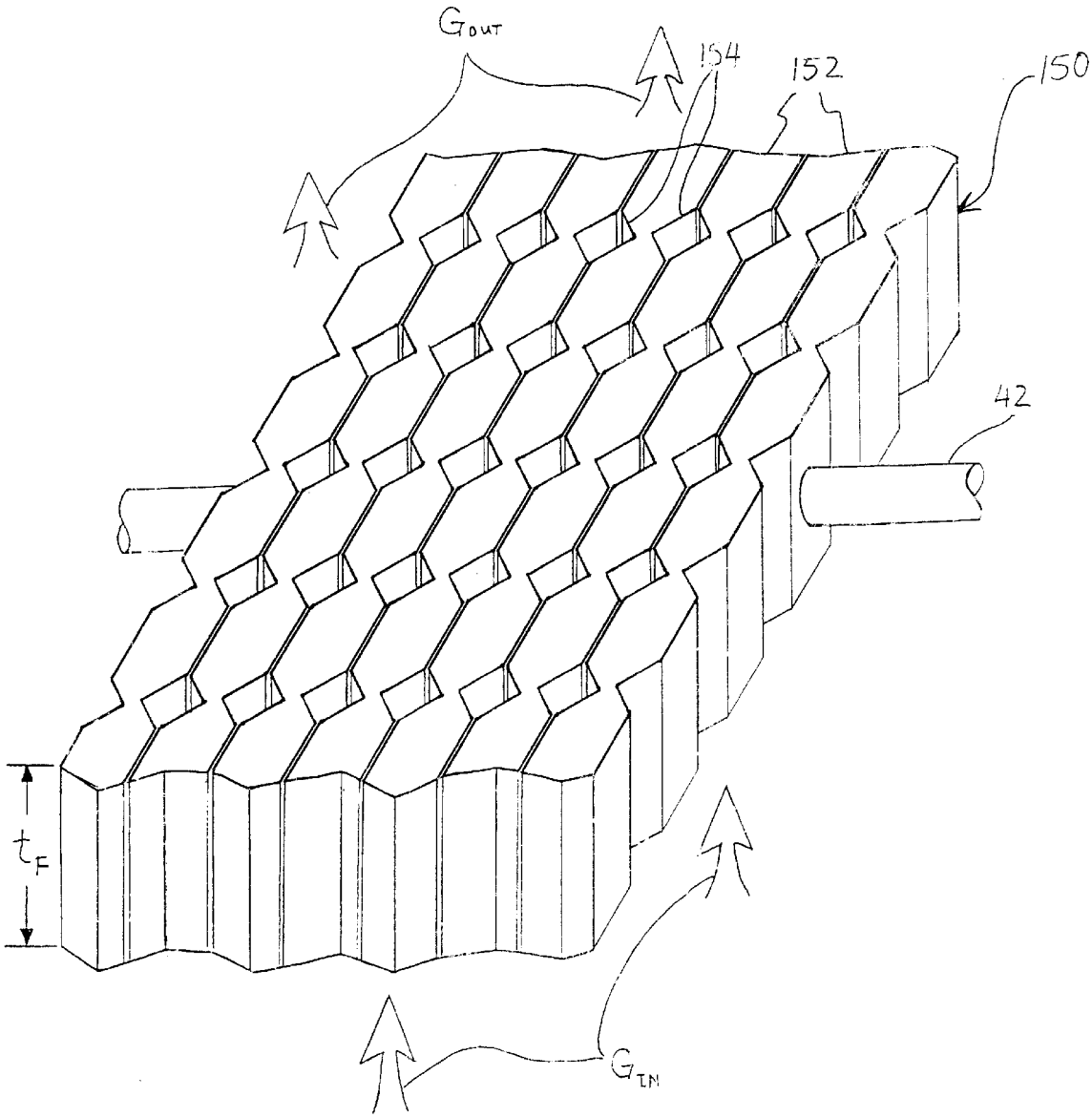
FIG. 9 is a partial perspective view of a fin and tube assembly according to the present invention embodying a thick fin that is fabricated of multiple layers of grooved material that are pressed together to provide a highly porous fin.

The tubes 42 can be mounted on or in the fins 46 by brazing, soldering, or other well-known methods that are suitable for providing a bonding surface with high thermal conductivity. The thicker fins 46 can be fabricated by stacking perforated thin metallic sheets, drilling individual holes, and other known manufacturing methods. Referring to FIG. 9, another way to assemble the thick fin 150 can include using long thin strips 152 of metal, each having a width equal to the desired fin thickness, $t_F$. The strips 152 can be grooved or otherwise shaped or configured such that when the strips 152 are mated together flow channels or orifices 154 are developed for gas, $G_{IN}$, to flow through. Of course, rods or wires or other shaping methods could be readily employed to obtain flow channels in a multi-layered thick fin. A stack of thin strips such as those shown in FIG. 9 allows for the channels to be oriented in the flow direction even if the flow approaches the thick fin at an angle.

In a working example of an embodiment of the present invention similar to that shown in FIGS. 2–4*a*, the inventors measured the UA per unit volume of a fin and tube assembly as described above against the UA per unit volume of a conventional finned, staggered-tube arrangement with fiat fins (i.e., 0.254 millimeters thick) and parallel air flow channels. Similar materials were used for both test assemblies, i.e., aluminum, with tube diameters of 25.4 millimeters, and both test assemblies were placed into the same air flow passage to provide equivalent volume or size restrictions. The fin and tube assembly according to the present invention had an inline tube arrangement, fin thickness of 0.79 millimeters, fins with circular orifices 0.85 millimeters in diameter formed by punching but removed material was not retained (as shown in FIG. 6*a*) and a porosity of 28 percent, and a fin density of 7 fins per inch was used. The following table provides a portion of the test data obtained during the testing that is relevant to showing the increased UA per unit of volume of the transpired fin and tube assembly. This information includes various frontal velocities, $V_f$, of the cooling air, the resultant of the overall heat transfer coefficient, U, times the total area of the fins, A, divided by assembly volume, V, and the improvement in UA/V at each frontal velocity, $V_f$.

| Conventional Finned-Tube | | Transpired Fin and Tube | |
|---|---|---|---|
| $V_f$ (m/s) | UA/V | UA/V | Increase in UA/V |
| 0.50 | 7,123 | 12,208 | 71.4% |
| 1.00 | 8,458 | 14,061 | 66.2% |
| 1.50 | 9,347 | 15,273 | 63.4% |
| 2.00 | 10,031 | 16,195 | 61.4% |
| 2.50 | 10,594 | 16,949 | 55.7% |
| 3.00 | 11,076 | 17,590 | 58.8% |
| 3.50 | 11,500 | 18,152 | 57.8% |

As can be seen from these test results, the transpired fin and tube assembly of the present invention provides a significant improvement in desirable heat transfer characteristics of a finned-tube heat exchanger at typical gas flow rates. Further, the measured improvements were achieved without optimization of design variables such as tube number, diameter, and material, fin porosity, fin pitch, and fin material, and it is believed that even higher improvements can be obtained with the inventive features of the present invention. Any optimization of the transpired fin and tube assembly will, of course, have to account for possible increases in pressure drops that may occur with the use of transpired fins over conventional heat exchangers, especially at higher gas velocities, and result in increased operating costs due to increased fan power can be balanced and overcome by increases in UA/V. For example, when the above assemblies were tested at the same fan powers, the increases in UA/V were lower, i.e., about 30 percent, but still provided a significant improvement at no added operating cost. Further, with the tested designs and for typical gas velocities of less than 5 meters per second with different fan powers, the total estimated cost, i.e., capital costs plus operating costs, of the transpired fin and tube assembly of the present invention is consistently less than the conventional finned-tube heat exchanger, thereby representing an improvement both in performance and in total cost.

The inventors performed computational fluid dynamics computer modeling of an embodiment similar to that shown in FIGS. 7 and 8*a* of the present invention. The model included fins made of material 12 millimeters thick with a porosity of 75 percent and circular holes with a 1.7 millimeter diameter. The fins were in thermal communication with 25.4 millimeter outside diameter tubes lying in the plane of the fins. The tubes were spaced 60 millimeters apart, as is the case in typical conventional heat exchangers. The results of the computer modeling showed that when operated at the same fan power of 11 watts per meter length of tube, the thick fin embodiment had a heat transfer rate of 942 Watts per meter length of tube compared to 500 Watts per meter of length for the convention finned tube design. In other words, the heat transfer rate of the thick fin embodiment provided an 88 percent increase in heat transfer rate over a conventional finned tube design at the same fan power. Clearly, the embodiment of thick transpired fins with tubes in the plane of the fins offers a considerable improvement in the ratio of heat transfer to fan power over conventional finned tube design, and this thick fin modeling shows that a significant portion of the increased heat transfer occurs within the orifices, thereby highlighting the advantages of high porosity.

The foregoing description is illustrative of the principles of the invention and provides specific examples of the heat transfer principles of the invention as applied to a finned-tube heat exchanger, and for ease of illustration, a standard condenser design was shown in the attached figures. However, the above discussion should not be limited to the specific examples shown but is expressly intended for other types of heat exchangers, including, but not limited to, liquid-to-gas, gas-to-liquid, and gas-to-gas type heat exchangers, in which improvement of the heat transfer rate on the gas side would prove beneficial. Further, those skilled in heat transfer processes will readily understand that the present invention may be successfully implemented, with or without modification as appropriate, in heat exchangers with staggered tube arrangements and with fin and tube assemblies arranged in series such that gas flows through more than one fin, as long as higher pressure drops are acceptable and/or more heat transfer is desired than can be achieved with a fin and tube assembly with a single fin pass and inline tube arrangement.

Similarly, the present invention expressly includes a fin and tube assembly that passes each tube through multiple, corrugated heat transfer elements, i.e., layered or nested elements, in which the gas flows through more than one fin. Additionally, it can readily be envisioned that heat exchangers with plates forming liquid conduits and contacting fins on the gas side would be improved by addition of the transpired fin feature of the invention and are within the scope of the above description and following claims. Each of these alternate configurations may be used in place of the heat exchanger or condenser shown in FIG. 1. It should be understood that a heat exchanger with nested, shallow flow channels or corrugations may provide more desirable heat transfer and pressure drop characteristics for a large, multi-row condenser such as that shown in FIG. 1, but variations to this design are within the scope of this invention. An important feature of the invention is that all or substantially all of the gas flowing through the heat exchanger is transpired through a heat transfer element(s) to enhance heat transfer surface area and increase the heat transfer coefficient, and it is believed by the inventors that this feature may be used in myriad design configurations, such as varying fin pitches, orifices size and spacing at different locations on the fin, materials, and fin thicknesses, once the above description of this feature is understood by those skilled in the art.

Accordingly, since numerous modifications and changes will readily occur to those skilled in the art, it is not desired to limit the invention to the exact construction and process shown and described above. Resort may be made to all suitable modifications and equivalents that fall within the scope of the invention as defined by the claims which follow. The words "comprise," "comprises," "comprising," "include," "including," and "includes" when used in this specification and in the following claims are intended to specify the presence of stated features, integers, components, or steps, but they do not preclude the presence or addition of one or more other features, integers, components, steps, or groups thereof.

The embodiments of the invention in which an exclusive property or privilege is claimed are defined as follows:

1. A heat exchanger for exchanging heat between a fluid and a gas having improved gas-side heat transfer characteristics, said heat exchanger comprising:

a housing having a hollow chamber that defines a flow path for gas flowing through said heat exchanger;

a conduit extending through said chamber transverse to said flow path of said gas and defining a flow path for fluid flowing through said heat exchanger;

a porous heat transfer element in heat conducting contact with said conduit and positioned in said flow path of said gas in said chamber, said porous heat transfer element having a porosity greater than about 25 percent, and a plurality of flow elements extending substantially through said porous heat transfer element and oriented substantially orthogonal to said porous heat transfer element;

wherein said conduit extends through said porous heat transfer element.

2. The heat exchanger of claim 1, wherein said heat transfer element is regularly corrugated to have a cross-sectional shape comprising alternating ridges and grooves and further comprising a plurality of porous heat transfer fins extending between adjacent ones of said ridges and said grooves, wherein adjacent pairs of said heat transfer fins form gas flow channels.

3. The heat exchanger of claim 2, wherein said conduit contacts each of said heat transfer fins to provide a heat transfer path between gas that flows through said gas flow channels and liquid that flows through said conduit.

4. The heat exchanger of claim 3, wherein said fluid conduit comprises a plurality of tubes fabricated from thermally conductive material, said tubes being selected from the group consisting of round, oval, and flat tubes.

5. The heat exchanger of claim 2, wherein adjacent heat transfer fins are in contact at each of said ridges and each of said grooves such that said flow channels are closed and all of the gas is transpired through said plurality of flow elements.

6. The heat exchanger of claim 2, wherein said heat transfer element has a heat transfer surface area for contacting said gas comprising front and rear surface areas of said heat transfer element and interior surface areas of said plurality of flow elements, and wherein said heat transfer element has a thickness and a porosity such that said interior surface areas comprise more than about one fourth of said heat transfer surface area.

7. The heat exchanger of claim 2, wherein at least a portion of each of said flow channels has a cross sectional configuration selected from the group consisting of a V-shape, a U-shape, a S-shape, a parabolic shape and a partial hexagonal shape.

8. The heat exchanger of claim 2, wherein adjacent heat transfer fins are in contact at each of said ridges and are at least partially spaced apart at each of said grooves such that said flow channels are open to allow at least a small amount of the gas to pass through said grooves.

9. The heat exchanger of claim 2, wherein adjacent heat transfer fins are in contact at each of said grooves and are at least partially spaced apart at each of said ridges such that said flow channels are open to allow at least a small amount of the gas to pass through said ridges.

10. The heat exchanger of claim 2, wherein adjacent heat transfer fins are at least partially spaced apart at each of said ridges and said grooves.

11. The heat exchanger of claim 1, wherein said heat transfer element has a porosity of greater than about 50 percent.

12. The heat exchanger of claim 1, wherein said porosity of said heat transfer element is greater than about 70 percent.

13. The heat exchanger of claim 1, wherein said plurality of orifices comprise a plurality of orifices having a substantial shape selected from the group consisting of circular, elliptical, and polygonal shapes.

14. The heat exchanger of claim 1, wherein said plurality of flow elements have a hydraulic diameter less than about twice the thickness of said heat transfer fins.

15. The heat exchanger of claim 14, wherein said hydraulic diameters are nonuniform.

16. The heat exchanger of claim 14, wherein the thickness of said heat transfer fins is greater than about 0.25 inches.

17. The heat exchanger of claim 14, wherein the thickness of said heat transfer fins is greater than about 0.03 inches.

18. The heat exchanger of claim 1, wherein said heat transfer element has a variable thickness.

19. The heat exchanger of claim 1, wherein orifices are formed in said heat transfer plate in such a manner so as to form an orifice contact surface with a frustoconical shape, a portion of said contact surface extending beyond a back surface of said heat transfer plate to provide an extended heat transfer area at each of said orifices.

20. The heat exchanger of claim 1, wherein orifices are formed in said heat transfer plate in such a manner so as to form an orifice contact surface with a frustaconical shape, a portion of said contact surface extending beyond a front surface of said heat transfer plate to provide an extended heat transfer area at each of said orifices.

21. The heat exchanger of claim 1, wherein said plurality of flow elements are arranged such that said porosity is non-uniform on said heat transfer element.

22. The heat exchanger of claim 1, wherein orifices are formed in said heat transfer plate in such a manner that material removed from said heat transfer plate is in hinge-like contact with a peripheral edge of each orifice to provide an extended heat transfer area at each of said orifices.

23. The heat exchanger of claim 2, wherein said heat exchanger comprises at least two of said heat transfer elements arranged in nested rows such that said gas flows sequentially through each of said rows.

24. The heat exchanger of claim 1, wherein a plurality of orifices through the heat transfer plate are arranged such that a spacing distance measured between two of said orifices varies on said heat exchanger plate.

25. A heat exchanger, comprising:

a chamber with a flow path for a first fluid through said heat exchanger;

a plurality of conduits extending through said chamber for passing a second fluid through said flow path, wherein exterior surfaces of said conduits contact said first fluid; and a porous heat transfer element comprising at lest one thermally conductive material with a porosity of at least 25 percent, said porous heat transfer element positioned transverse to said flow path in said chamber, whereby said first fluid is transpired through said porous heat transfer element, and wherein said conduits are in substantially continuous heat conducting contact with said heat transfer element; and a plurality of flow elements extending substantially through said porous heat transfer element and oriented substantially orthogonal to said porous heat transfer element;

wherein said conduit extends through said porous heat transfer element.

26. The heat exchanger of claim 25, wherein said first fluid is a gas and wherein said gas is transpired through said porous heat transfer element.

27. The heat exchanger of claim 25, wherein said porosity of said heat transfer element is greater than about 50 percent.

28. The heat exchanger of claim 25, wherein said porosity of said heat transfer element is greater than about 70 percent.

29. The heat exchanger of claim 25, wherein said heat transfer element comprises a plurality of fins positioned with leading edges and trailing edges of said fins arranged such that said heat transfer element has a cross sectional shape comprising alternating ridges and grooves, wherein adjacent of said fins form flow channels through which said first fluid is directed, and wherein said flow channels are closed to force said first fluid to transpire through said porous heat transfer element.

30. The heat exchanger of claim 29, wherein said heat element comprises less than about 1 fin per inch.

31. The heat exchanger of claim 25, wherein the heat transfer element comprises a plurality of fins with ends contacting said liquid conduits and being arranged such that said heat transfer element has a substantially planar cross section.

32. The heat exchanger of claim 31, wherein said fins have a thickness of at least about 0.25 inches.

33. The heat exchanger of claim 32, wherein said fins include a plurality of contacting sheets, said sheets being configured to form said pores therebetween for said first fluid to flow through said heat exchanger.

34. The heat exchanger of claim 29, wherein said fins have a thickness greater than about 0.25 inches and said porosity is provided by said plurality of flow elements, wherein said plurality of flow elements each extend through said plurality of fins.

35. The heat exchanger of claim 29, wherein said hydraulic diameter of said plurality of orifices differs at differing locations on said fins.

36. The heat exchanger of claim 29, wherein said plurality of orifices have a substantial shape selected from the group consisting of circular, elliptical, and polygonal shapes.

37. The heat exchanger of claim 25, wherein said heat transfer element has a first thickness and a second thickness differing from said first thickness.

38. The heat exchanger of claim 25, wherein said porosity is non-uniform at differing locations on said heat transfer element.

39. The heat exchanger of claim 30, wherein said heat transfer element comprises at least two nested rows of said heat transfer fins arranged such that said first fluid flows sequentially through each of said rows.

40. The heat exchanger of claim 39, wherein said heat transfer element comprises a substantially planar, first fin and a substantially planar, second fin positioned adjacent and substantially parallel to said first fin such that said first fluid transpires first through said first fin and second through said second fin.

41. The heat exchanger of claim 1, wherein said porous heat transfer element comprises a porous heat transfer plate.

42. The heat exchanger of claim 25, wherein said porous heat transfer element comprises a porous heat transfer plate.

43. The heat exchanger of claim 1, wherein said plurality of flow elements comprise a plurality of orifices.

44. The heat exchanger of claim 25, wherein said plurality of flow elements comprise a plurality of orifices.

45. The heat exchanger of claim 34, wherein said plurality of flow elements comprise a plurality of orifices.

46. The heat exchanger of claim 29, wherein said plurality of orifices comprise a hydraulic diameter less than about twice the thickness of said fins.

47. The heat exchanger of claim 2, wherein at least a portion of said flow elements extend substantially through said plurality of porous heat transfer fins.

48. A heat exchanger for exchanging heat between a fluid and a gas having improved gas-side heat transfer characteristics, said heat exchanger comprising:

a housing having a hollow chamber that defines a flow path for gas flowing through said heat exchanger;

a conduit extending through said chamber transverse to said flow path of the gas and defining a flow path for fluid flowing through said heat exchanger;

a porous heat transfer element in heat conducting contact with said conduit and positioned in said flow path of said gas in said chamber, said porous heat transfer element having a porosity greater than about 25 percent, wherein said heat transfer element is regularly corrugated to have a cross-sectional shape comprising alternating ridges and grooves; and a plurality of porous heat transfer fins extending between adjacent ones of said ridges and said grooves, wherein adjacent pairs of said heat transfer fins form gas flow channels;

wherein adjacent heat transfer fins are in contact at each of said ridges and are at least partially spaced apart at each of said grooves such that said flow channels are open to allow at least a small amount of the gas to pass through said grooves.

49. A heat exchanger for exchanging heat between a fluid and a gas having improved gas-side heat transfer characteristics, said heat exchanger comprising:

a housing having a hollow chamber that defines a flow path for gas flowing through said heat exchanger;

a conduit extending through said chamber transverse to said flow path of the gas and defining a flow path for fluid flowing through said heat exchanger;

a porous heat transfer element in heat conducting contact with said conduit and positioned in said flow path of said gas in said chamber, said porous heat transfer element having a porosity greater than about 25 percent, wherein said heat transfer element is regularly corrugated to have a cross-sectional shape comprising alternating ridges and grooves; and a plurality of porous heat transfer fins extending between adjacent ones of said ridges and said grooves, wherein adjacent pairs of said heat transfer fins form gas flow channels;

wherein adjacent heat transfer fins are in contact at each of said grooves and are at least partially spaced apart at each of said ridges such that said flow channels are open to allow at least a small amount of the gas to pass through said ridges.

50. A heat exchanger for exchanging heat between a fluid and a gas having improved gas-side heat transfer characteristics, said heat exchanger comprising:

a housing having a hollow chamber that defines a flow path for gas flowing through said heat exchanger;

a conduit extending through said chamber transverse to said flow path of the gas and defining a flow path for fluid flowing through said heat exchanger;

a porous heat transfer element in heat conducting contact with said conduit and positioned in said flow path of said gas in said chamber, said porous heat transfer element having a porosity greater than about 25 percent, wherein said heat transfer element is regularly corrugated to have a cross-sectional shape comprising alternating ridges and grooves; and a plurality of porous heat transfer fins extending between adjacent ones of said ridges and said grooves, wherein adjacent pairs of said heat transfer fins form gas flow channels;

wherein adjacent heat transfer fins are at least partially spaced apart at each of said ridges and said grooves.

51. A heat exchanger, comprising:

a chamber with a flow path for a first fluid through said heat exchanger;

a plurality of conduits extending through said chamber for passing a second fluid through said flow path, wherein exterior surfaces of said conduits contact said first fluid; and a porous heat transfer element comprising at least one thermally conductive material with a porosity of at least 25 percent and having a first thickness and a second thickness differing from said first thickness, said porous heat transfer element positioned transverse to said flow path in said chamber, whereby said first fluid is transpired through said porous heat transfer element, and wherein said conduits are in substantially continuous heat conducting contact with said heat transfer element.

* * * * *